US006118957A

United States Patent [19]

Fujiwara et al.

[11] Patent Number: 6,118,957

[45] **Date of Patent: *Sep. 12, 2000**

[54] SEALING MEMBER, PROCESS CARTRIDGE AND DEVELOPER SUPPLY CONTAINER

[75] Inventors: Yasuo Fujiwara, Kashiwa; Hiroumi Morinaga, Susono; Toshiaki Nagashima, Mishima, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/126,389

[22] Filed: Jul. 30, 1998

[30] Foreign Application Priority Data

Aug. 1, 1997 [JP] Japan ..... 9-221004
Jul. 14, 1998 [JP] Japan ..... 10-198780

[51] Int. Cl.[7] ..... G03G 15/08

[52] U.S. Cl. ..... 399/103; 399/106; 399/262

[58] Field of Search ..... 399/103, 106, 399/111, 119, 120, 262; 222/DIG. 1, 505, 541.1, 544, 559; 220/258, 350, 359.1, 359.2, 359.3, 359.4

[56] References Cited

U.S. PATENT DOCUMENTS

| | | | |
|---|---|---|---|
| 4,614,286 | 9/1986 | Yamaguchi et al. | 222/DIG. 1 |
| 4,895,104 | 1/1990 | Yoshino et al. | 399/109 |
| 4,931,838 | 6/1990 | Ban et al. | 399/106 |
| 5,150,807 | 9/1992 | Seyfried et al. | 399/106 |
| 5,491,542 | 2/1996 | Nagashima et al. | 399/106 |
| 5,513,679 | 5/1996 | Yamada | 399/103 X |
| 5,523,828 | 6/1996 | De Kesel | 399/103 |
| 5,689,772 | 11/1997 | Fujiwara et al. | 399/106 |
| 5,752,131 | 5/1998 | Fujiwara et al. | 399/106 |
| 5,778,282 | 7/1998 | Nagashima | 399/106 |
| 5,832,349 | 11/1998 | Nagashima | 399/262 |

FOREIGN PATENT DOCUMENTS

| | | |
|---|---|---|
| 0788033A1 | 8/1997 | European Pat. Off. . |
| 59-13262 | 1/1984 | Japan . |
| 59-013262 | 1/1984 | Japan . |
| 63-060164 | 3/1988 | Japan . |
| 63-60164 | 4/1988 | Japan . |
| 7-013422 | 1/1995 | Japan . |
| 8-030170 | 2/1996 | Japan . |
| 8-305257 | 11/1996 | Japan . |

*Primary Examiner*—Matthew S. Smith
*Assistant Examiner*—Hoan Tran
*Attorney, Agent, or Firm*—Fitzpatrick, Cella, Harper & Scinto

[57] ABSTRACT

A sealing member for sealing a developer accommodating portion for accommodating a developer includes (a) a sealing portion for openably sealing an opening of the developer accommodating portion; (b) an extended portion extending from the sealing portion, the extended portion having a width, measured in a direction of extension, which is smaller than that of the sealing portion; (c) a connecting edge for connecting an edge of the sealing portion adjacent the extended portion and a side edge of the extended portion extending in the direction of the extension; and (d) a tearable portion capable of being torn to open the opening sealed by the sealing portion, wherein an end of the tearable portion is provided in the sealing portion, and the other end thereof continues to the connecting edge, wherein the tearable portion extends between the one end and the other end substantially parallel with the extension direction.

89 Claims, 15 Drawing Sheets

SEALING MEMBER, PROCESS CARTRIDGE AND DEVELOPER SUPPLY CONTAINER

FIELD OF THE INVENTION AND RELATED ART

The present invention relates to a sealing member for sealing a developer accommodating portion for accommodating a developer, a process cartridge detachably mountable to a main assembly of an electrophotographic image forming apparatus, using the sealing member, and a developer supply container for supplying the developer into a main assembly of an electrophotographic image forming apparatus using the sealing member.

Here, the term electrophotographic image forming apparatus refers to the one which forms images on recording materials using an electrophotographic image formation type method. Examples of the electrophotographic image forming apparatus include an electrophotographic copying machine, an electrophotographic printer (laser beam printer, LED printer or the like), a facsimile machine and a word processor.

The term "process cartridge" refers to a cartridge having as a unit an electrophotographic photosensitive member, and at least one of charging means for charging the electrophotographic photosensitive member, a developing means for developing the latent image formed on the electrophotographic photosensitive member and cleaning means for removing a developer remaining on the electrophotographic photosensitive member, the cartridge being detachably mountable relative to a main assembly of the electrophotographic image forming apparatus.

In an electrophotographic image forming apparatus using an electrophotographic image forming process, the process cartridge type is known. The process cartridge type is advantageous in that maintenance of the apparatus can be in effect carried out by the users, and therefore, operativity is remarkably improved. For this reason, the process cartridge type is widely used in the field of the image forming apparatus.

A developing device used in the process cartridge, comprises a toner accommodating container having an opening sealed by a sealing member, and a developing container coupled therewith.

When the process cartridge is used, the user tears the sealing member to open the toner accommodating container. The toner is supplied to the developing container from the toner accommodating container through the opening thus opened.

Examples of the sealing member include a so-called easy peel film, which is one film to be removed upon the start of use, and a so-called tear tape or an integral cover film having a tearable portion, wherein the tearable portion is torn out of the cover film upon the start of use. The tear tape sealing method has recently been widely used since the force required for unsealing or opening is small.

Use of a tearable sealing member has been proposed in for example, Japanese Laid-open Patent Application No. SHO-59-13262 and Japanese Laid-open Utility Model Application No. SHO-63-60164. Furthermore, a proposal has been made as to avoid oblique pulling upon unsealing. For example, U.S. Pat. No. 5,752,131 (Japanese Laid-open Patent Application No. HEI-7-13422) discloses a regulating member for regulating the seal pulling direction. As another example, U.S. Pat. No. 5,689,772 (Japanese Laid-open Patent Application No. HEI-8-030170) discloses that the seal pulling direction is regulated by the toner container and the developing container. Japanese Laid-open Patent Application No. HEI-8-305257, discloses a seal draw-out opening that is effective to regulate the seal pulling direction.

SUMMARY OF THE INVENTION

Accordingly, it is a principal object of the present invention to provide a sealing member which can be assuredly teared. It is another object of the present invention to provide a sealing member which can be smoothly torn.

It is a further object of the present invention to provide a sealing member for sealing a developer accommodating portion for accommodating a developer, comprising (a) a sealing portion for openably sealing an opening of the developer accommodating portion; (b) an extended portion extended from the sealing portion, the extended portion having a width, measured in a direction of extension, which is smaller than that of the sealing portion; (c) a connecting edge for connecting an edge of the sealing portion adjacent the extended portion and a side edge of the extended portion extending in the direction of the extension; (d) a tearable portion capable of being torn to open the opening sealed by the sealing portion, wherein an end of the tearable portion is provided in the sealing portion, and the other end thereof continues to the connecting edge, wherein the tearable portion extends between the one end and the other end substantially parallel with the extension direction.

It is a further object of the present invention to provide a process cartridge and a developer supply container using such a sealing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described using an exemplary electrophotographic image forming apparatus to which a process cartridge including a developing device is mountable.

Embodiment 1

(General Arrangement)

Figure 16:
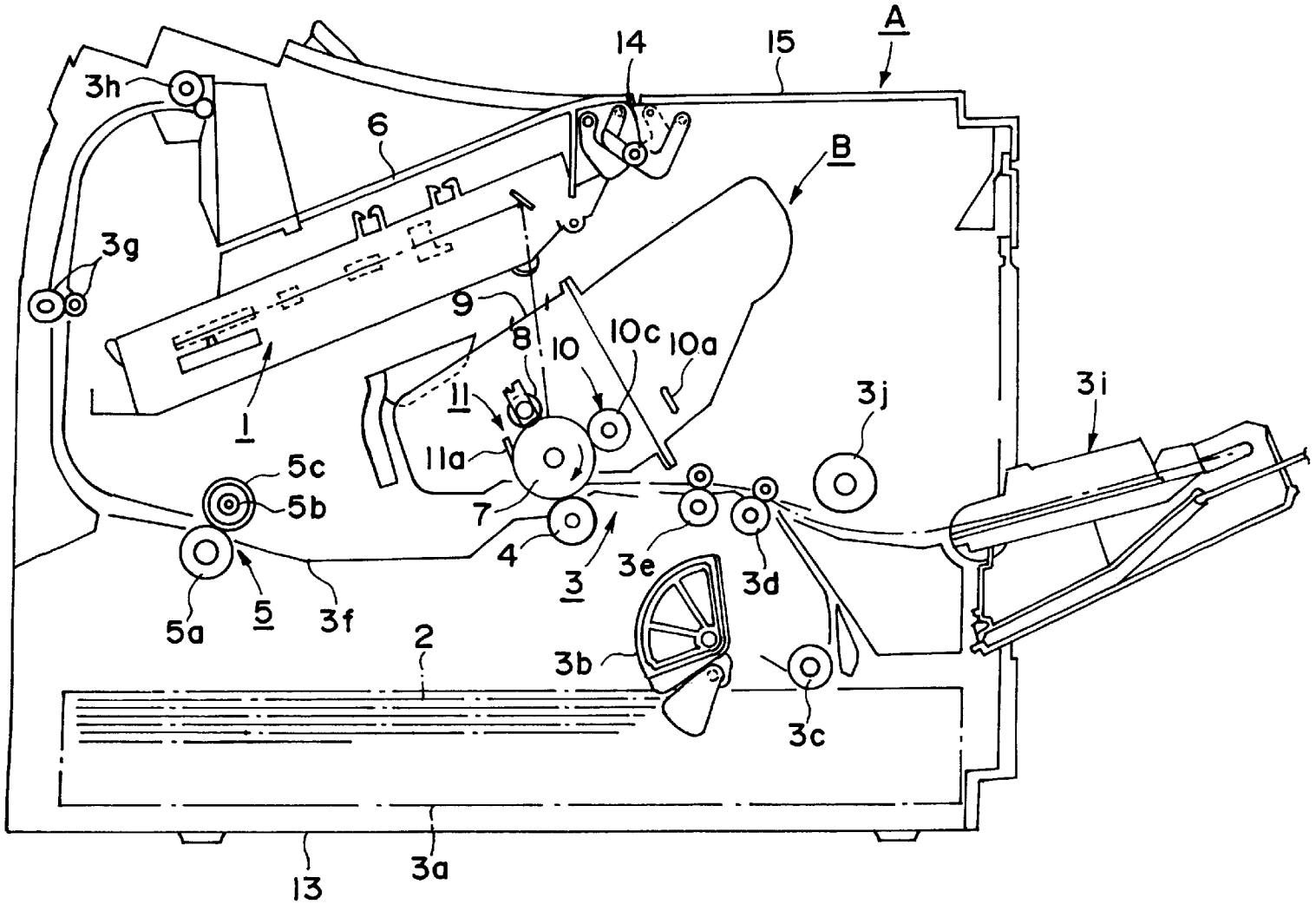
FIG. 16 is a longitudinal sectional view illustrating the structure of an image forming apparatus to which a process cartridge is mounted.

In the electrophotographic image forming apparatus A, as shown in FIG. 16, a latent image is formed on a photosensitive drum 7 (image bearing member) by projection of a laser beam image from an optical system 1 in accordance with image information, and is developed with toner into a toner image. In synchronism with formation of the toner image, a recording material 2 is fed out of a cassette 3*a* by feeding means 3 including a pick-up roller 3*b*, feeding rollers 3*c*, feeding rollers 3*d*, and registration rollers 3*e*. The toner image formed on the photosensitive drum in the process cartridge B is transferred onto the recording material 2 by voltage application to a transfer roller 4 as transferring means in the apparatus A. The recording material 2 is fed to fixing means along a guide plate 3*f*. The fixing means 5 comprises a driving roller 5*a* and a fixing roller 5*c* having therein a heater 5*b* to apply the heat and the pressure to the recording material 2 passing therethrough. The recording material 2 is fed by a couple of discharging rollers 3*g*, 3*h* and is discharged to a discharging portion 6 through a reverse feeding path. The image forming apparatus A is provided with a manual insertion tray 3*i* and rollers 3*j* for permitting manual insertion feeding.

Figure 17:
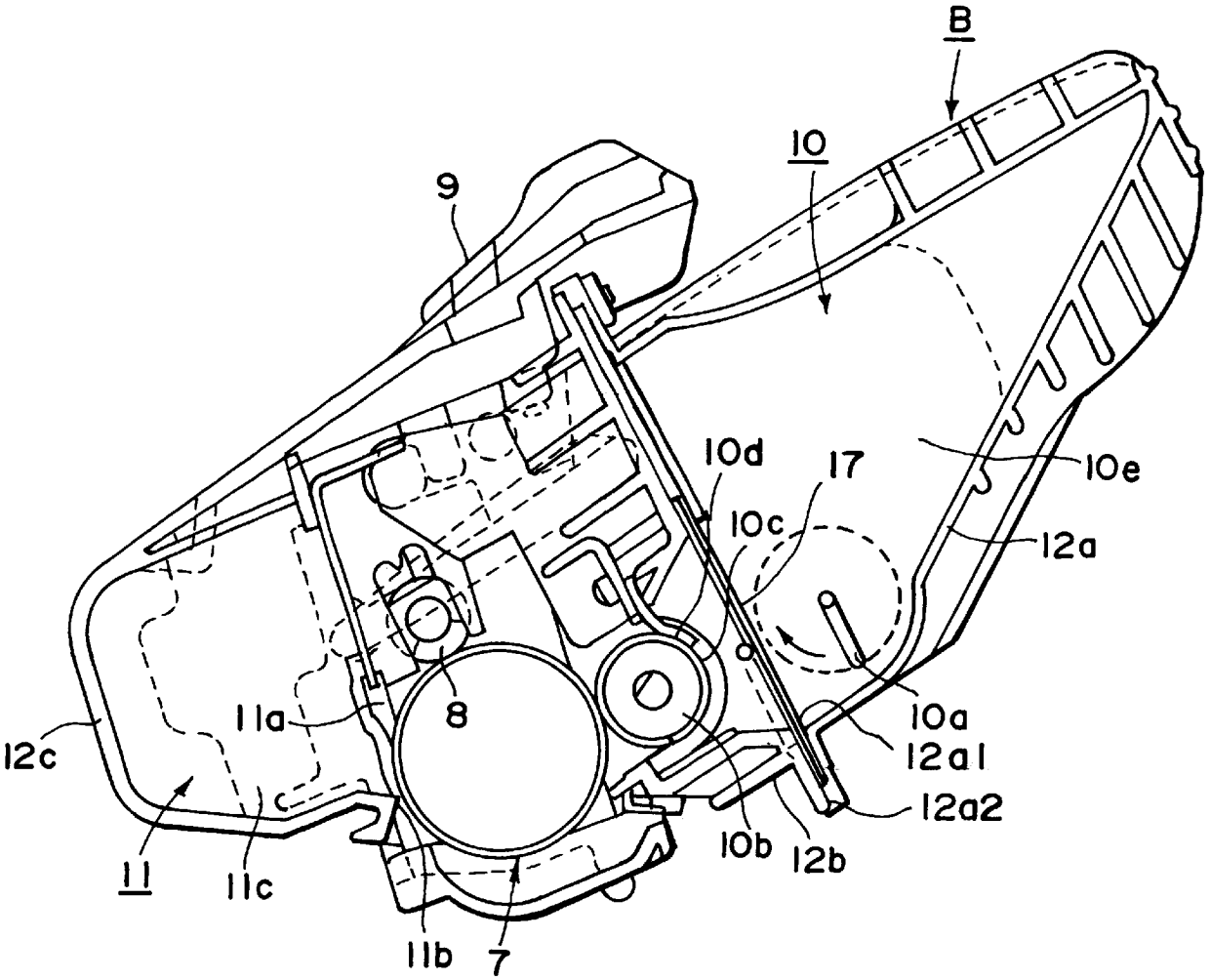
FIG. 17 is a longitudinal sectional view illustrating the structure of the process cartridge.

On the other hand, the in process cartridge B, as shown in FIG. 17, the photosensitive drum 7 having a photosensitive layer is rotated, and the surface thereof is uniformly charged by voltage application to the charging roller 8 (charging means). A light image is projected from the optical system 1 through an opening 9 onto the photosensitive drum 7 to form a latent image, which is in turn developed by developing means 10.

The developing means 10 feeds the toner from the toner accommodating portion by rotation of the toner feeding member, and rotates the developing roller 10*c* which contains therein a fixed magnet 10*b*. By this, a layer of the toner triboelectrically charged by the developing blade 10*d* is formed on the surface of the developing roller 10*c*, and the toner is supplied to the photosensitive drum 7 in accordance with the latent image to form the toner image(visual image). Then, the transfer roller 4 is supplied with a voltage having an opposite polarity from the toner image to transfer the toner image onto the recording material 2. Thereafter, the toner remaining on the photosensitive drum 7 is removed by a cleaning blade 11*a* of cleaning means 11, and is received by a receptor sheet 11*b* and then a residual toner container 11*c* of the cleaning means 11.

A frame for the developing device is constituted by a toner accommodating container 12*a* accommodating the toner and a developing frame 12*b* for supporting the developing member, such as a developing roller 10*c*, which are welded to each other. The cartridge B is constituted by coupling a cleaner container 12*c* supporting the photosensitive drum 7, the cleaning blade 11*a* and the charging roller 8, with the integral developing device frame. The process cartridge B is detachably mountably mounted to cartridge mounting means provided in the main assembly 13 of the apparatus.

Figure 18:
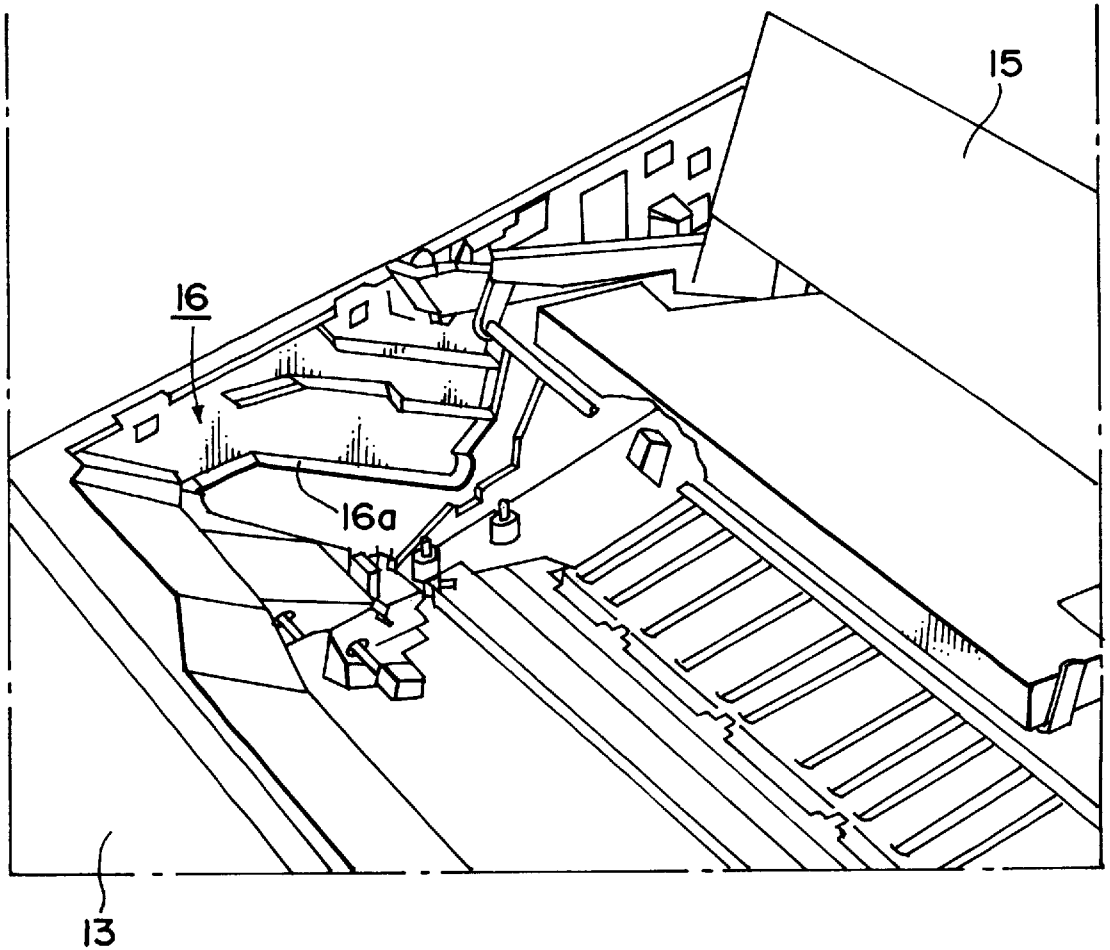
FIG. 18 is a perspective view illustrating the mounting structure of the process cartridge.
Figure 19:
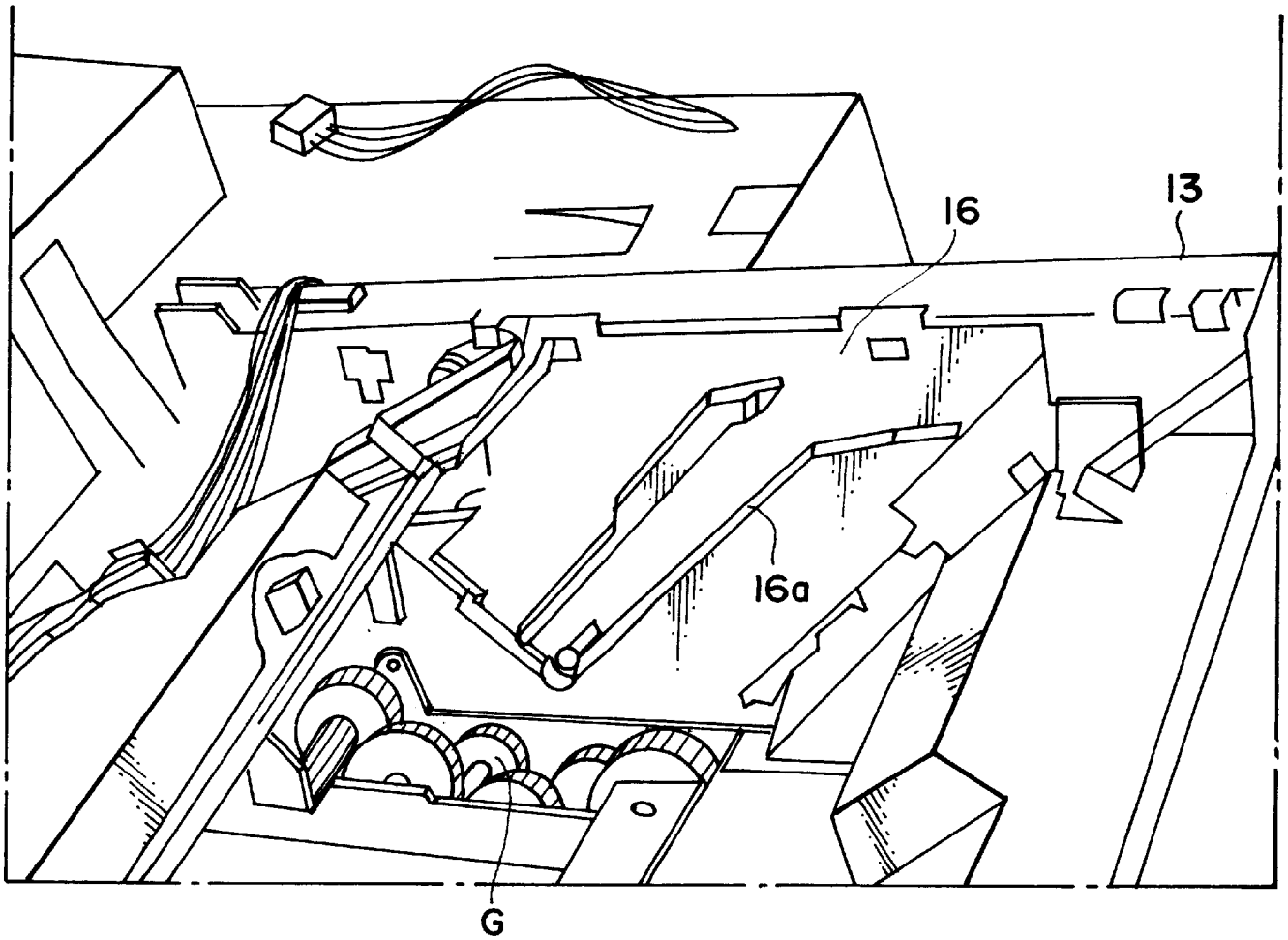
FIG. 19 is a perspective view illustrating the mounting structure of the process cartridge.

In the cartridge mounting means, when an openable member 15 provided in the main assembly A of the apparatus is opened by rotation about a shaft 14, cartridge guiding members 16 are mounted opposing to each other on the left and right inner surfaces in a cartridge mounting space, as shown in FIGS. 18 and 19. The left and right guiding members 16 are provided with opposing guide portions 16*a* which function as a guide when the process cartridge B is inserted. The process cartridge B is mounted to the image forming apparatus A by inserting the process cartridge B along the guide portions 16*a* and then closing the openable member 15. By such mounting, a drum gear (unshown) mounted to a longitudinal end portion of the photosensitive drum 7 is brought into meshing engagement with a drive transmission gear G (FIG. 19) provided in the main assembly 13 of the apparatus to enable driving force transmission to the photosensitive drum 7.

(Coupling structure between the toner container and the developing frame)

A description will be provided for a coupling structure between the developing frame 12*b* and the toner container 12*a* constituting the frame of the developing device.

Figure 3:
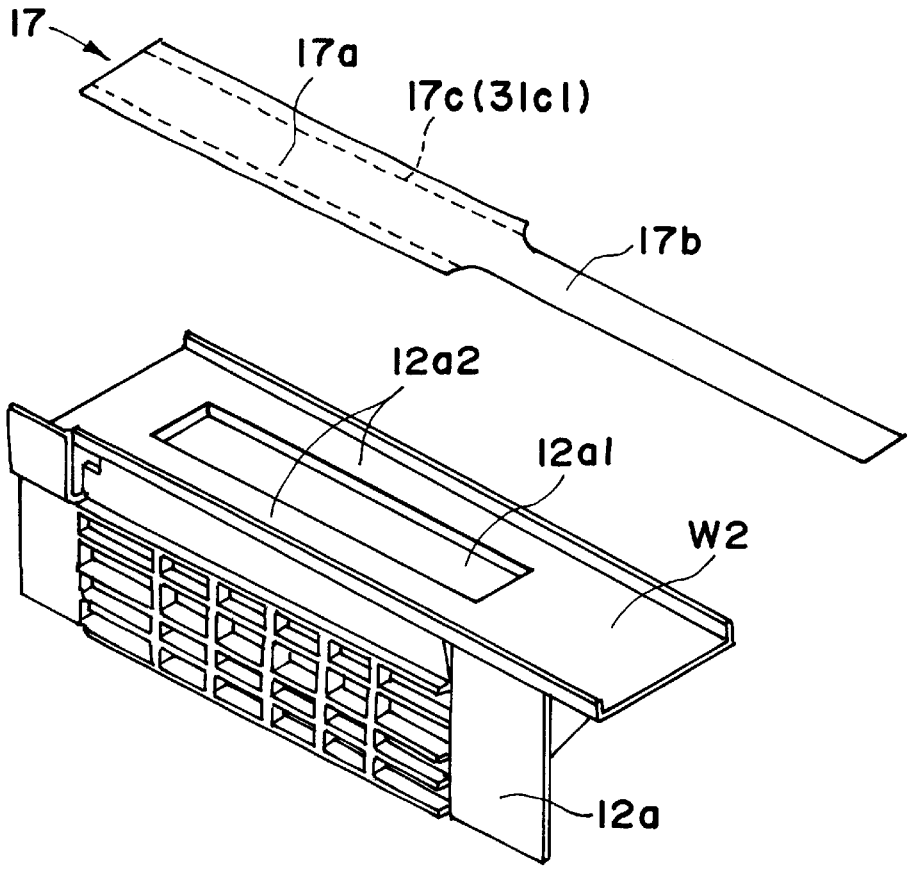
FIG. 3 is a perspective view illustrating a toner seal and a toner accommodating container.

As shown in FIG. 3, the toner accommodating container 12*a* is provided with an opening 12*a*1. A flange 12*a*2 is formed around the opening 12*a*1. The opening 12*a*1 is openably sealed by a tearable seal member 17 (sealing member) The seal member 17, as shown in FIG. 3, has a cover seal portion 17*a* (sealing portion) mounted by a heat seal to the flange 12*a*2 to hermetically close the opening 12*a*1. The seal member 17 is provided with a drawing portion 17*b* in the form of an extended portion extended from the cover seal portion 17*a*. The cover seal portion 17*a* and the drawing portion 17*b* are constituted by a single sheet and are folded back and overlapped to constitute the seal member 17.

The drawing portion 17*b* has a mechanical strength sufficient to permit the cover seal portion 17*a* to be torn.

Figure 7:
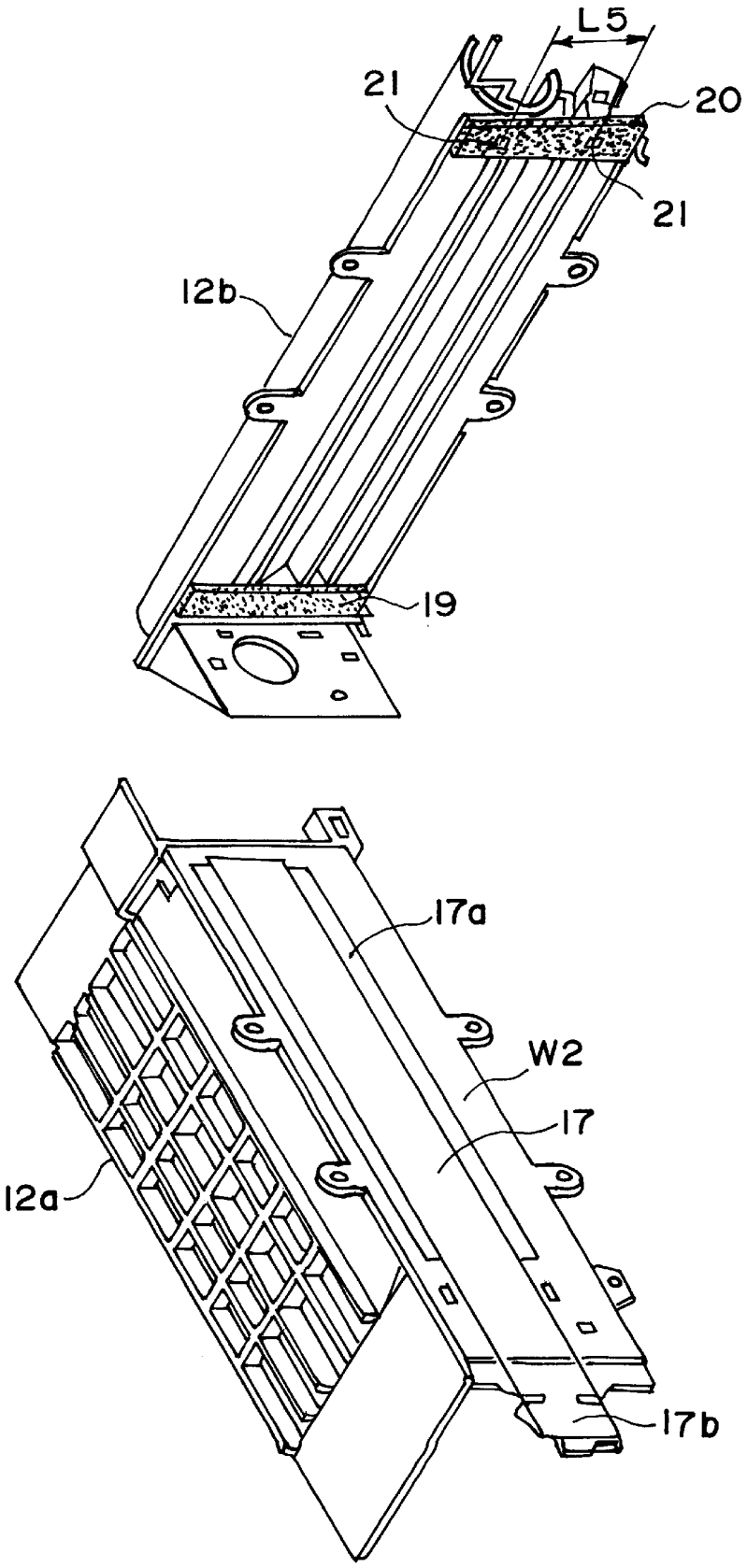
FIG. 7 is a perspective view illustrating the combination of a developing container and a toner accommodating container.

As shown in FIGS. 3, 7, the tearable seal member 17 is stuck or pasted on the flange 12*a*2 around the opening 12*a*1. A welded portion W2 is provided extended in the longitudinal direction at each side of the seal member 17. The developing frame 12*b* has parallel welding ribs (unshown) welded by ultrasonic welding in contact with the welded portion W2 of the toner accommodating container 12*a*. After the toner accommodating container 12*a* and the developing frame are welded, the welding rib is positioned at each side of the seal member 17. The toner accommodating container has a gap between the toner accommodating container 12*a* and the developing frame 12*b*. The welding rib is a projection having a triangular section. Upon vibration welding, the section of the welding rib is substantially rectangular. At the longitudinal opposite ends of the gap between the toner accommodating container 12*a* and the developing frame 12*b*, there are seal members 19, 20 of elastic material, such as polyurethane foam, for plugging the container gap, which are mounted to the developing frame 12*b*. The seal member 20 at one end presses against the drawing portion 17*b* of the seal member 17 to the toner accommodating container 12*a*.

Figure 1:
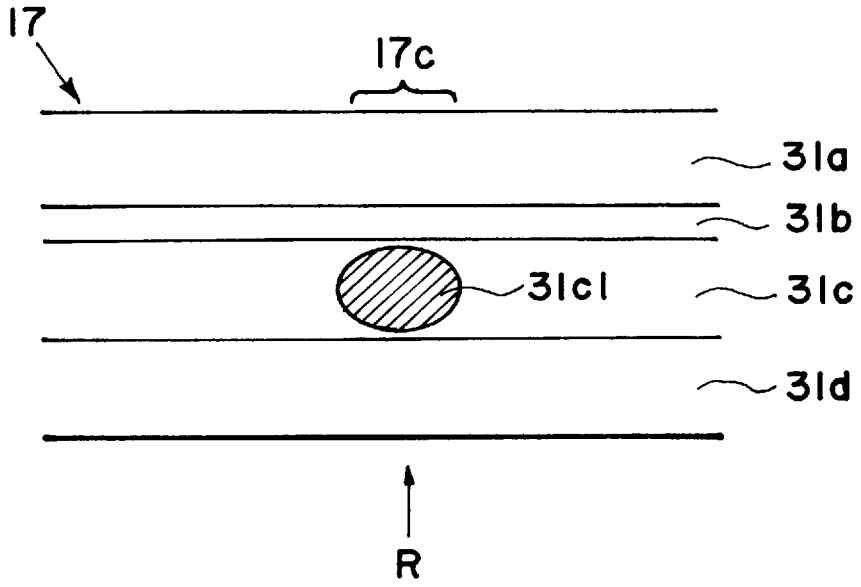
FIG. 1 is a sectional view of a toner seal according to an embodiment of the present invention.
Figure 2:
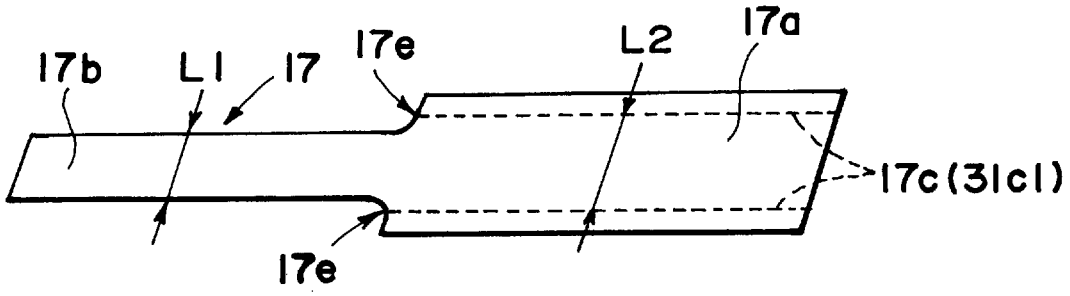
FIG. 2 is a perspective view of a toner seal.

As shown in FIGS. 1 and 2, the seal member 17 of the present invention comprises a surface layer 31*a*, a laser blocking layer 31*b* for blocking a laser beam, a guide layer 31*c*, which is usable by laser beam, and a sealant layer 31*d* for welding the sealing member, in the order named in the direction of its thickness.

The surface layer 31*a* is of biaxial orientation polyester film (PET). The thickness thereof is preferably 10 μm–20 μm, and further preferably is 12 μm–17 μm to maximize the heat sealing condition when it is mounted to the toner accommodating container 12*a*, and to assure the tearability while maintaining its easy tearing property.

The surface layer 31*a* of the tearable seal member 17, is made of biaxial orientation polyester film (PET) having a thickness of approximately 12 μm.

The laser blocking layer 31*b* is made of aluminum foil since it does not absorb the laser blocking layer 31*b* beam energy, and since it can assuredly avoid deterioration of the film strength of the surface layer 31*a* due to crystallization by radiation heat upon heat fusing of the guide layer 31*c* when the carbon oxide gas laser R is applied to the sealant layer 31*d* side. The thickness of the aluminum foil is preferably 5 μm–15 μm, and further preferably 7 μm–12 μm, and in this embodiment, it is approximately 7 μm.

Guide layer 31*c* is made of biaxial orientation polyester film (PET). The guide layer 31*c* absorbs the carbon oxide gas laser R energy to fuse by the continuous projection of the laser beam thereto at the laser projecting portion 31*c*1. It should not absorb so much laser energy as to damage the sealant layer 31*d*, while permitting speedy laser machining. For this reason, it has preferably a thickness of 40 μm–70 μm, and further preferably 40 μm–60 μm, and in this embodiment, it is approximately 50 μm.

The material of sealant layer 31*d* is ethylene=vinylacetate copolymer resin material (EVA) since it has a sufficient heat sealing property and bonding strength. The thickness of the sealant layer 31*d* is preferably 40 μm–70 μm. Further preferably, it is 40 μm–60 μm, and is approximately 50 μm in this embodiment.

Figure 22:
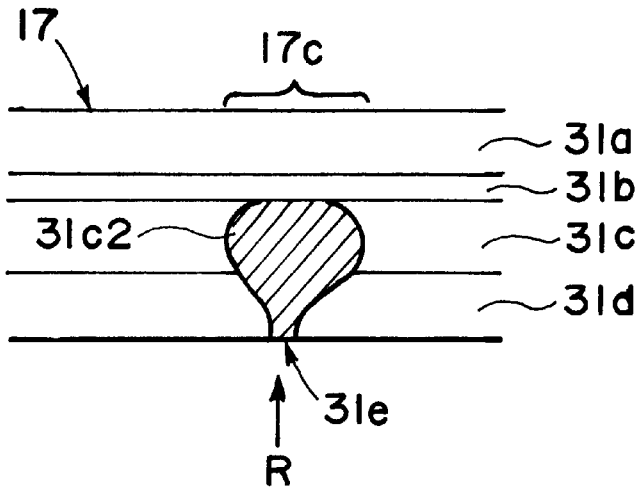
FIG. 22 is a sectional view of a toner seal.
Figure 23:
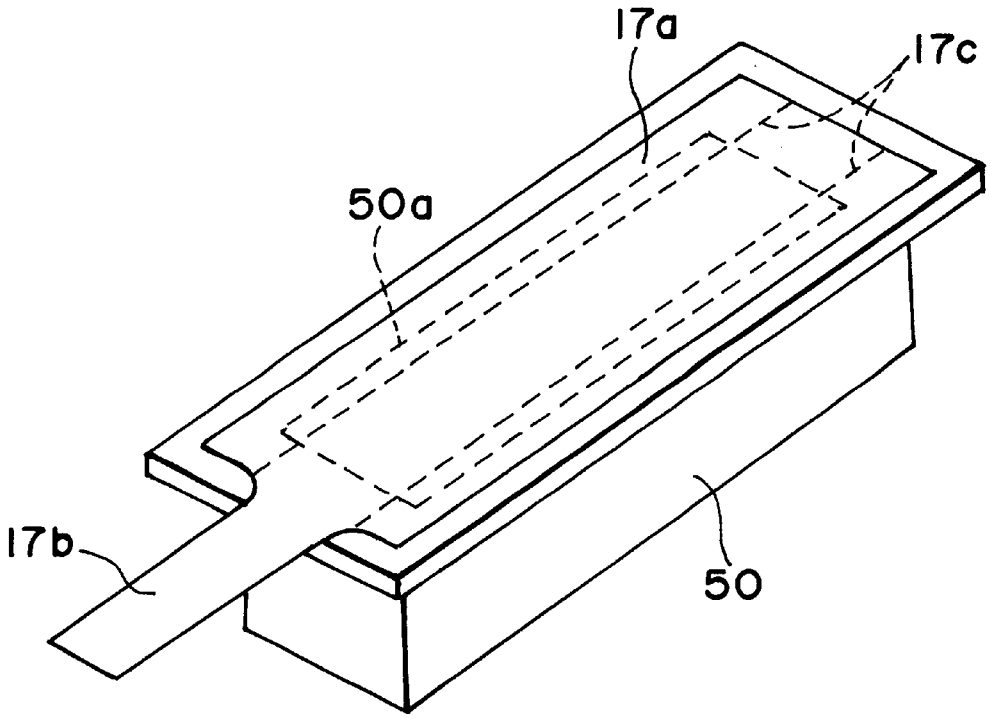
FIG. 23 is a perspective view of a developer supply container provided with a sealing member.

The sealant content ratio of the vinylacetate copolymer resin material (VA) in the sealant layer 31*d* is not more than 10 wt. %, and the molecular weight distribution(gel permeation) of the ethylene=vinylacetate copolymer resin material does not have a local minimum in the range less than 100,000 of the molecular weight but has at least one local minimum in the range not less than 100,000 thereof. This is done to present the sealant layer 31*d* from being stuck (blocking) under a high temperature and high humidity ambience on the seal member 19 at a side where the drawing portion 17*b* of the seal member 17 is projected to prevent unsealing, after the toner accommodating container 12*a* is coupled with the developing frame 12*b*, The laser is applied on the sealant layer 31*d* side of the seal member 17 to fuse at least one layer of the seal member 17 to form a cavity. For example, as shown in FIG. 1, the guide layer 31*c* is fused to form the cavity 31*c*1, or as shown in FIG. 22, the guide layer 31*c* and the sealant layer 31*d* are fused to provide a cavity 31*c*2 having an opening 31*e*. Along the cavity or cavities, a tearable portion 17*c* is formed to permit the opening 12*a*1 to be opened. The cavity may be formed by cutting a part of the seal member. Alternately, formation of fine perforations is usable to provide the tearable portion 17*c*.

The layers from the surface layer to the sealant layer 31*d*, inclusive, are bonded by dry lamination.

In this embodiment, the film thickness after the dry lamination is 128 μm.

The developing device of this embodiment includes a toner accommodating container 12*a* having an opening 12*a*1. It also includes the seal member 17, having the integral cover seal portion 17*a* and the drawing portion 17*b*, for seal the opening 12*a*1 and permitting unsealing upon the start of use. The width L1 of the drawing portion 17*b* of the seal member 17 is narrower than the distance or interval L2 between the two tearable portions portion 17*c*. In a boundary region between the cover seal portion 17*a* and the drawing portion 17*b*, there is formed an edge portion 17*e* as a connecting portion where the width is reduced from the cover seal portion 17*a* to the drawing portion 17*b*, and to the connecting portion, the tearable portion 17*c* extends. The edge portion 17*e* and the tearable portion 17*c* cross with each other inclinedly at the end.

Figure 9:
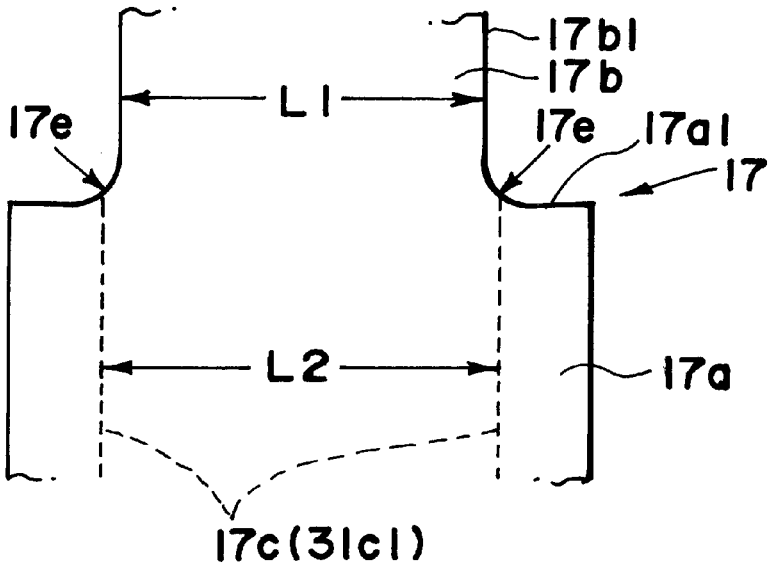
FIG. 9 is a top plan view of a free end portion of the toner seal.
Figure 13:
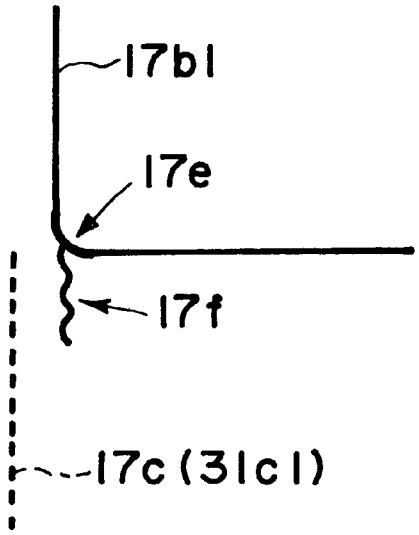
FIG. 13 is a top plan view of a free end portion of the toner seal.
Figure 14:
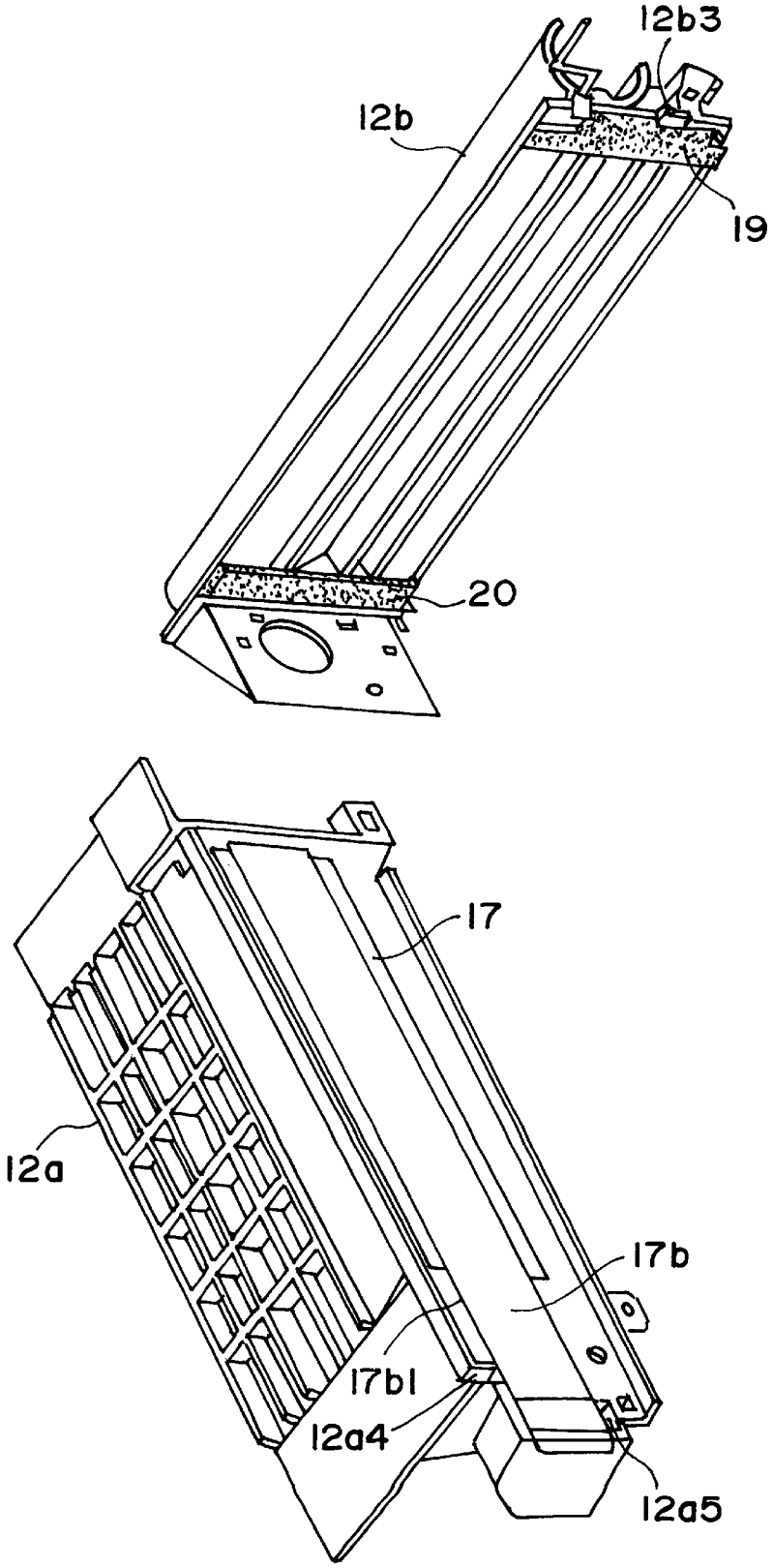
FIG. 14 is a perspective view illustrating a combination of a developing container and a toner accommodating container and illustrating an engagement guide.

As shown in FIGS. 2 and 9, the seal member 17 has the drawing portion 17*b* with a free end, and the cover seal member 17*a*. Ideally, it continuously extends from each edge 17*b*1 of the drawing portion 17*b* to the tearable portion (half cut portion) 17*c* which extends along the laser projected portion (cavity portion)31*c*1. However, from the standpoint of the accuracy in the punching in the seal manufacturing operation (outer configuration), some tolerance is to be provided. For example, if the half cut portion results in being formed inside the drawing portion 17*b* at the free end, there is a liability that, as shown in FIG. 13, the film cutting 17*f* may start at the edge portion 17*e* (extension of the edge 17*b*1 at each side of the drawing portion 17*b*). Therefore, it is preferable that width of the drawing portion 17*b* (free end) is slightly smaller than the distance between the two tearable portions 17*c*.

As shown in FIGS. 2, 9, the width L1 of the drawing portions 17*b* is narrower than the distance L2 (=the width of the laser projecting portion 31*c*1) between the two linear tearable portions 17*c*.

In this embodiment, the width L1 of the drawing portions 17*b* is approximately 32 mm, and the distance L2 between the tearable portions 17*c* is approximately 34 mm so that the difference between L1 and L2 is approximately 1 mm at each side.

Figure 10:
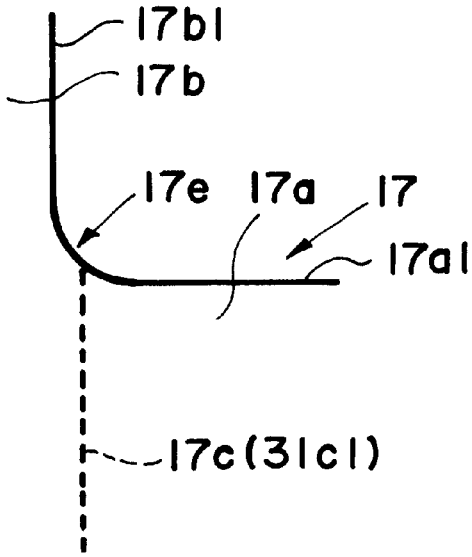
FIG. 10 is a top plan view of a free end portion of the toner seal.

As shown in FIG. 10, the configuration of the edge portion 17*e* where tearing end comes, is arcuate to permit smooth tearing. Tearing stability is to be taken into consideration, that is, the tearing is assured by concentrating the stress at the end of the tearing portion 17*c*. Also, the pulling stability is to be taken into account, that is, the film is not broken at the edge portion 17*e* while maintaining the smooth continuous drawing operativity during the manufacturing drawing process of the seal member 17. In view of these factors, the edge portion 17*e* is arcuate, and the radius R thereof is preferably 1–2.5 mm, and further preferably is it 1.5–2 mm, and it is approximately 2 mm in this embodiment. If the radius R is too large, the stress is not sufficiently concentrated on the portion 17*c*, and therefore, the tearing property is not good, and if it is too small, continuous drawing processing is difficult. The arcuate edge portion 17*e* continues to the edge 17*b*1 of the drawing portion 17*b*. In this example, the edge portion 17*e* also continues to the end 17*a*1 of the boundary region relative to the drawing portion 17*b* of the cover seal portion 17*a*.

One end of the tearable portion 17*c* provided along the laser projecting portion 31*c*1 (said laser-machined portion) continues to the arcuate portion of the edge portion 17*e*. In this example, the edge configuration 17*e* is rounded, and the laser projecting portion 31*c*1 is disposed approximately 1 mm outside the edge 17*b*1 of the drawing portion 17*b*. The position of the laser projecting portion 31*c*1 is liable to be deviated due to the manufacturing tolerance, and if it is deviated outwardly or inwardly, the stress concentration onto the laser projecting portion 31*c*1 is weakened with the result that tearing is difficult. The distance L2 between the tearable portion 17*c* provided by the laser machining corresponding to the opening 12*a*1 of the toner accommodating container 12*a* is larger than the width L1 of the drawing portions 17*b* (free end portions). However, when it is torn in combination with the seal pattern 33, which will be described hereinafter, it is not torn at a position out of the tearing portion 17*c* at the edge portion 17*e*.

Figure 4:
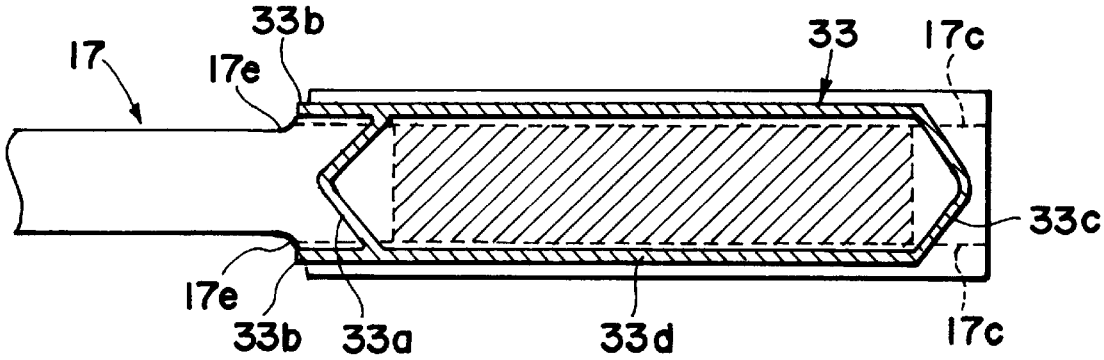
FIG. 4 is a top plan view illustrating a heat seal pattern.
Figure 6:
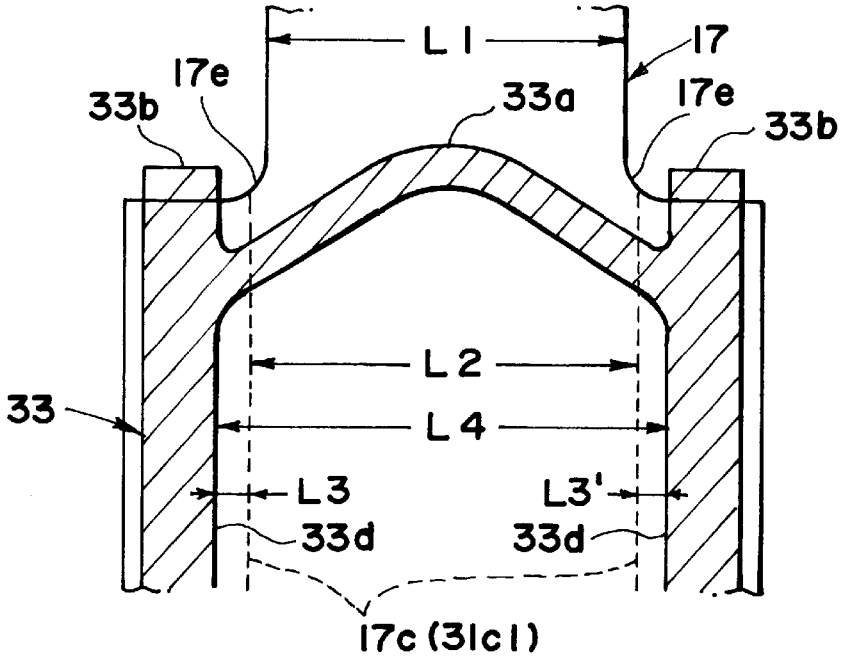
FIG. 6 is a top plan view illustrating the positional relation of the heat seal pattern.

FIGS. 4, 6 show the portions where the cover seal portion 17*a* is mounted to the flange 12*a*2 of the toner accommodating container 12*a*. In FIG. 4, the zone of the hatched lines extending from upper left to the lower right, and in FIG. 6 the zone of the hatched lines extending from the upper right to the lower left are portions (seal pattern) on which the cover seal portion 17*a* is mounted by a heat seal. A horn-like pattern 33*b* is provided at each of the edge portions 17*e*. An L-shaped seal pattern 33*a* is provided so as to connect the horn-like patterns 33*b*. Another L-shaped seal pattern 33*c* is provided at the opposite longitudinal end. At the end portion, the horn-like pattern 33*b* functions to prevent the seal from being torn along a line out of the guide 17*c*, thus accomplishing stable tearing.

Figure 5:
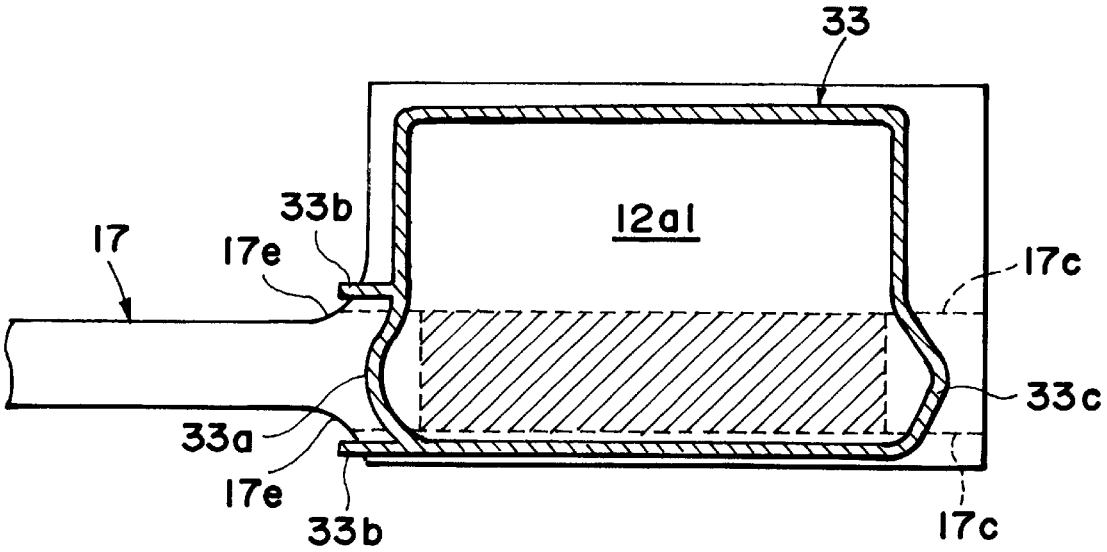
FIG. 5 is a top plan view illustrating the heat seal pattern.

FIG. 5 shows a case in which the opening 12*a*1 is not at the central portion of the toner accommodating container 12*a*, that is, the seal pattern 33 is such that cover seal portions 17*a* are not symmetrical as seen in the drawing direction of the seal member 17. In such a case, the horn-like pattern 33*b* is effective to prevent the edge portion 17*e* from being torn out of the position of the portion 17*c*.

The distance L4 between the left and right inner edges 33*d* of the seal pattern 33 having the horn-like pattern, may be smaller than the distance L2 between the two tearable portions 17*c*, but is preferably larger than that. Distances L3 and L3' between the tearable portion 17*c* and the inner edge 33*d* of the seal pattern, are preferably larger than a predetermined distance from the standpoint of the tearing stability of the seal member 17, more particularly, they are not less than 0.5 mm. Further desirably, it is not less than 1 mm.

A description will be provided as to the tearing stability. When the inner edge 33*d* of the seal pattern 33 overlaps the laser projecting portion 31*c*1 of the guide layer, the laser projecting portion 31*c*1 of the guide layer receives additional heat and the pressure during the heat seal operation. By making the distance 14 between the left and right inner edges 33*d* of the seal pattern 33 larger than the distance 12 between the two tearable portions 17*c*, it can be avoided with certainty that deterioration due to the laser projecting portion 31*c*1 of the guide layer results in the occurrence of the peeling away from the guide or in the occurrence of peeling between the layers of the film.

In this embodiment, from this standpoint, the distances L3 and L3' between the laser projecting portion 31*c*1 of the guide layer and the inner edge 33*d* of the seal pattern, is approximately 1 mm and approximately 1.5 mm.

The seal member 17 manufactured so as to satisfy the above, has been actually mounted by heat sealing on the toner accommodating container 12*a* provided with the toner feeding member 10*a* (FIG. 17) as shown in FIG. 3.

The laser machining device for the seal member 17 is of a water cooling type carbon oxide laser and produces a laser beam having a wavelength of 10.6 μm at the output of approximately 8W, wherein the laser spot diameter is approximately 0.1 mm, and the laser machining speed is approximately 12 m/min., and the film distance between the laser beam generation end and the film distance is approximately 38.6 mm.

The toner accommodating container 12*a* has been injection-molded from shock resistant polystyrene (HIPS), and the opening 12*a*1 is approximately 30 mm in width, approximately 210 mm in length, and the inside volume is approximately 460 cc.

The seal member 17 has a surface layer having a thickness of approximately 12 μm (biaxial orientation polyester PET). Therefore, a wide range of seal condition is available, such as a heat sealing temperature of 130° C.–180° C., a seal pressure of 4 kgf/cm$^2$–7 kgf/cm$^2$ (cylinder bore diameter of 100 ϕ), and the sealing period of 2–5 sec approximately. In this embodiment, the seal temperature was approximately 180° C., the seal pressure was approximately 4 kgf/cm$^2$, and the seal time was approximately 3 sec.

The seal pattern was as shown in FIGS. 4 and 6 (seal pattern 33), and the seal width was approximately 3 mm along the entire circumference, including the horn-like pattern 33*b* portions.

The toner accommodating container 12*a* manufactured in this manner was coupled with the developing frame 12*b*, as shown in FIG. 7, to produce a developing device 10.

The drawing portion 17*b* at the free end of the seal member 17 folded back is extended out of the draw-out opening. A developing frame 12*b* to which the seal members 19, 20 of polyurethane foam are bonded at the leading and trailing end portions, is welded thereto by ultrasonic welding along the entire length at both of the sides only.

The seal members 19, 20 are made of polyurethane foam(foamed into approximately 18 times) having a thickness of the approximately 2 mm, and is collapsed to approximately 1 mm between the toner accommodating container 12*a* and the developing frame 12*b* after the welding to assure the seal property after the unsealing.

Figure 8:
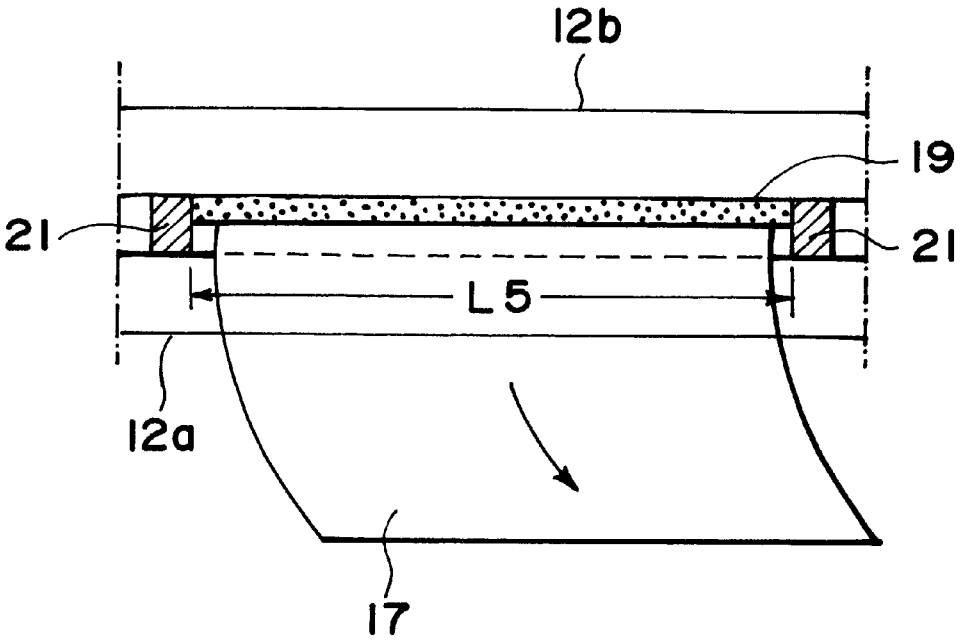
FIG. 8 is a sectional view of a seal draw-out opening.

At the draw-out opening, as shown in FIGS. 7, 8, the developing frame 12*b* is provided with a regulating member 21 for regulating the drawing direction of the seal, which is known from Japanese Laid-open Patent Application No. HEI-7-13422. The regulating member 21 may be provided on the developing frame 12*b*. The inner distance L5 of the direction regulating members 21 is slightly larger than the distance of the tearable portions 17*c* of the toner seal.

At the initial stage of the unsealing the drawing portion 17*b* having the width L1 is pulled. However, with the unsealing action continued, the portion torn out of the cover seal portion 17*a* and having a width substantially the same as the width L2 of the tearable portion, is drawn out (width becomes larger). In order to properly regulate the direction of the smooth tearing at the edge portion 17*e*, it is desirable that the distance between the two regulating members 21, that is, the width L5 at the seal draw-out opening is larger than the width L2 of the tearable portion 17*c* by not less than 0.1 mm and less than 2 mm at one side. Further desirably, it is wider by not less than 1 mm and not more than 1.5 mm at one side.

With the developing device 10 manufactured in the manner described in the foregoing, the smoothness of the seal pulling at the seal draw-out opening, the operativity, the tearing stability and the withstand pressure property have been checked.

The developing device 10 was fixed, and seal was pulled straight in the direction of approximately 180° at a pulling speed of 5000 mm/ min. Approximately in one case, and it was pulled obliquely at about 10°, which may occur in actual situations in the other case; and the smoothness of pulling, the unsealing strength, the stability of the opened width (widening) were checked.

For the withstand pressure property check, the toner accommodating container 12*a* was filled with approximately 250 g of the one component magnetic toner having the average particle diameter of approximately 7 μm, and it was permitted to fall with the seal surface faced down from predetermined levels to check the impact acceleration (so-called "G") at which the seal was removed or broken. The level at which it fell was raised to determine the limit acceleration(G) without the seal removal or breakage.

As a result, the seal was smoothly pulled until the opening of the toner supply opening without clogging at the seal draw-out opening both when the seal was pulled straight or when it was pulled obliquely. As regards operativity, the peeling strength is approximately 3 kgf which is good. As regards the tearing stability, the seal was torn along the tearable portions 17*c,* and stabilized widths of the opening were provided. No peeling was observed between layers.

The withstand pressure acceleration was as large as 150G, which is sufficient.

(Embodiment 2)

Figure 11:
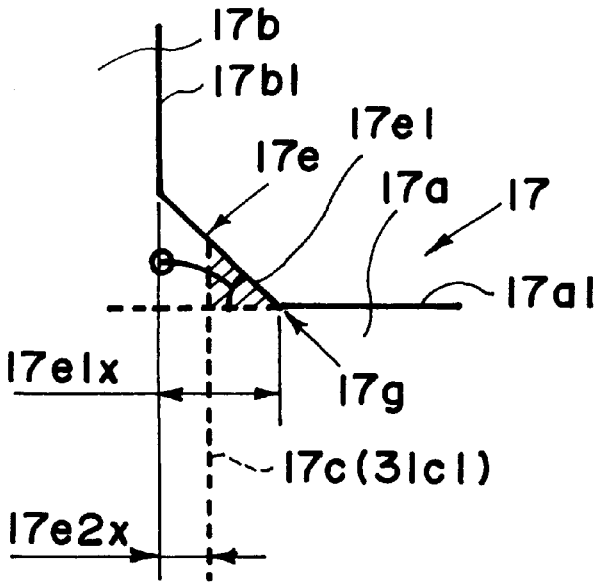
FIG. 11 is a top plan view of a free end portion of the toner seal.

The toner accommodating container 12*a* and the developing device 10 of this embodiment has the same structures as with Embodiment 1 except that configuration of the edge portion 17*e* to which the tearable end of the seal member 17 reaches is an inclined line configuration (rectilinear configuration), as shown in FIG. 11.

A complementary angle θ between the edge 17*b*1 of the drawing portion 17*b* and the edge portion 17*e* is desirably approximately 30°–60° to permit smooth unsealing. The angle e is more particularly the angle formed between the portion 17*e*1 of the boundary portion in the portion to remain and the end 17*a*1 of the cover seal portion 17*a*.

Figure 12:
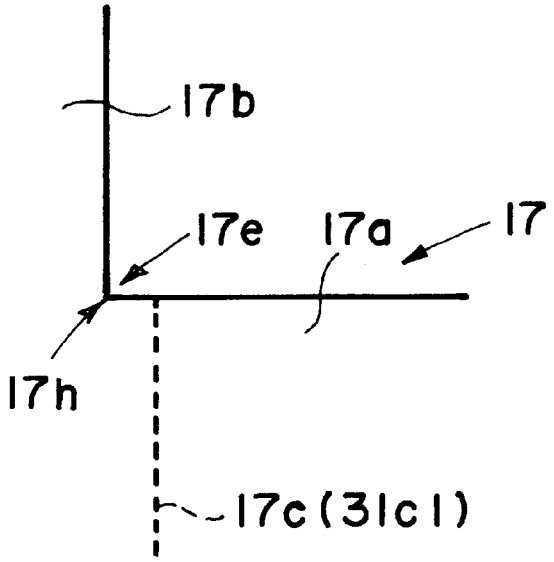
FIG. 12 is a top plan view of a free end portion of the toner seal.
Figure 21:
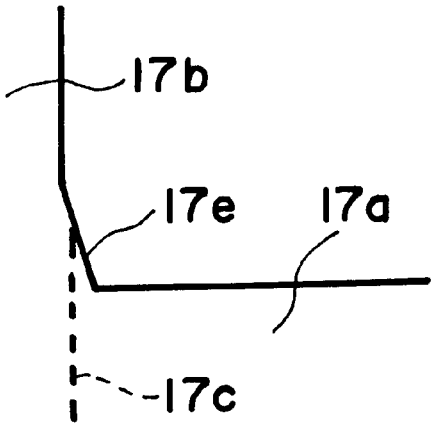
FIG. 21 is a top plan view of a free end portion of the toner seal.

When the angle θ is less than 30° or not less than 60°, the configuration at the edge portion 17*e* is close to a perpendicular. When the angle θ is less than 30°, the configuration is more like the one as shown in FIG. 12. When the angle θ is not less than 60°, the configuration is as shown in FIG. 21, and the stress does not concentrate on the portion 17*c,* so that tearing stability is not enough.

In this embodiment, as shown in FIG. 11, the angle θ is approximately 45°, and the size 17*c*1x of the hatched portion of the edge portion 17*e* is approximately 1 mm. As regards the position of the portion 17*c* indicated by the hatched portions, the distance 17*e*2x between 17*c* and 17*b*1 is approximately 0.5 mm so that it is located substantially at the center of the hatched portion 17*c*.

In this example, similar to Embodiment 1, a manufacturing tolerance is necessary, but because of the location at the center of the hatched portion 17*c,* inner or outer deviation would not result in the departure from the hatched portion 17*c*. As a result, the film end can be pulled at a constant angle at all times, and therefore, the tearing stability is higher than in Embodiment 1 using a rounded configuration.

The size of the hatched portion 17*e* is desirably as small as possible provided that the tearing portion 17*c* is not out of the hatched portion 17*c* even in view of the manufacturing tolerance of the seal, more particularly, it is desirably not more than 2 mm and not more than 1 mm. The smaller the hatched portion 17*c* is, the more the stress is concentrated on the portion 17*c* upon the unsealing, thus improving the easy tearing property.

As regards the position of the guide 17*c* in the hatched portion 17*e,* the distance between 17*b*1 and 17*c* is desirably as large as possible (closer to the 17*g* (intersection between 17*e* and 17*a*1 in FIG. 11)), provided that guide 17*c* is not out of the hatched portion 17*c* in view of the film deviation due to the manufacturing tolerances of the seal. This is because then the stress tends to concentrate, and therefore, easy tearing is improved.

Figure 20:
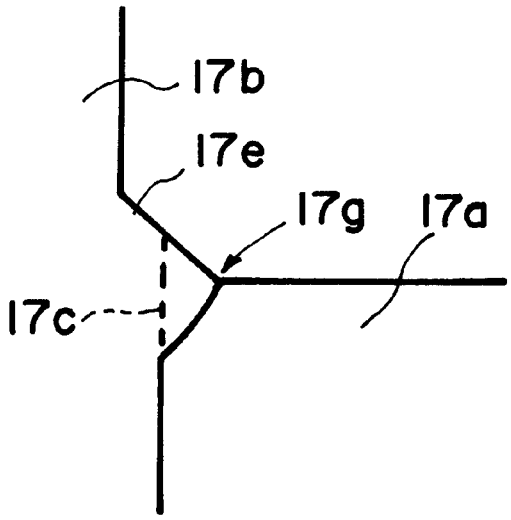
FIG. 20 is a top plan view illustrating a free end portion of the toner seal.

In this example, the stress concentration is sufficient even when the easy tearing property of the film per se is poor due to variations of the material, the thickness, and the lamination strengths between layers of the film. Even when the tearing does not occur at the portion 17*c,* the seal is torn at the position 17*g* as shown in FIG. 20, and the tearing portion comes immediately to 17*c*.

With the developing device 10 manufactured in the manner described in the foregoing, the smoothness of the seal pulling at the seal draw-out opening, the operativity, the tearing stability and the withstand pressure property have been checked, as in Embodiment 1. As a result, the seal was smoothly pulled until the opening of the toner supply opening without clogging at the seal draw-out opening both when the seal was pulled straight or when it was pulled obliquely. As regards the operativity, the peeling strength is approximately 3 kgf which is good. As regards the tearing stability, the seal was teared along the tearable portions 17*c,* and stabilized widths of the opening were provided. No peeling was observed between layers.

The withstand pressure acceleration was as large as 150G which is sufficient.

(Embodiment 3)

In the foregoing embodiments, a regulating member 21 is particularly provided, but in this embodiment, an engagement guide for the engagement between the toner accommodating container 12*a* and the developing frame 12*b* is used as the regulating member for regulating the seal drawing direction. This embodiment is the same as Embodiment 1 in the other respect.

The engagement guide comprises an outer wall member 12*a*4 projected integrally from the toner accommodating container 12*a,* a guide projection 12*b*3 integral with the developing frame 12*b,* and a lightening recess of the toner accommodating container 12*a* engaging with the guide projection 12*b*3. The outer wall member 12*a*4 has an end which is bent toward the edge 17*b*1 of the drawing portion 17*b*. The guide projection 12*b*3 and the recess 12*a*5 function as an engagement guide when the toner accommodating container 12*a* and the developing frame 12*b* are coupled with each other, and the outer wall member 12*a*4 and the guide projection 12*b*3 function to regulate the seal drawing direction when the seal is removed.

With the developing device 10 manufactured in the manner described in the foregoing, the smoothness of the seal pulling at the seal draw-out opening, the operativity, the tearing stability and the withstand pressure property have been checked, as in Embodiment 1. As a result, the seal was smoothly pulled until the opening of the toner supply opening without clogging at the seal draw-out opening both when the seal was pulled straight or when it was pulled obliquely. As regards the operativity, the peeling strength is approximately 3 kgf which is good. As regards the tearing stability, the seal was torn along the tearable portions 17*c,* and stabilized widths of the opening were provided. No peeling was observed between layers.

The withstand pressure acceleration was as large as 150G, which is sufficient.

(Embodiment 4)

Figure 15:
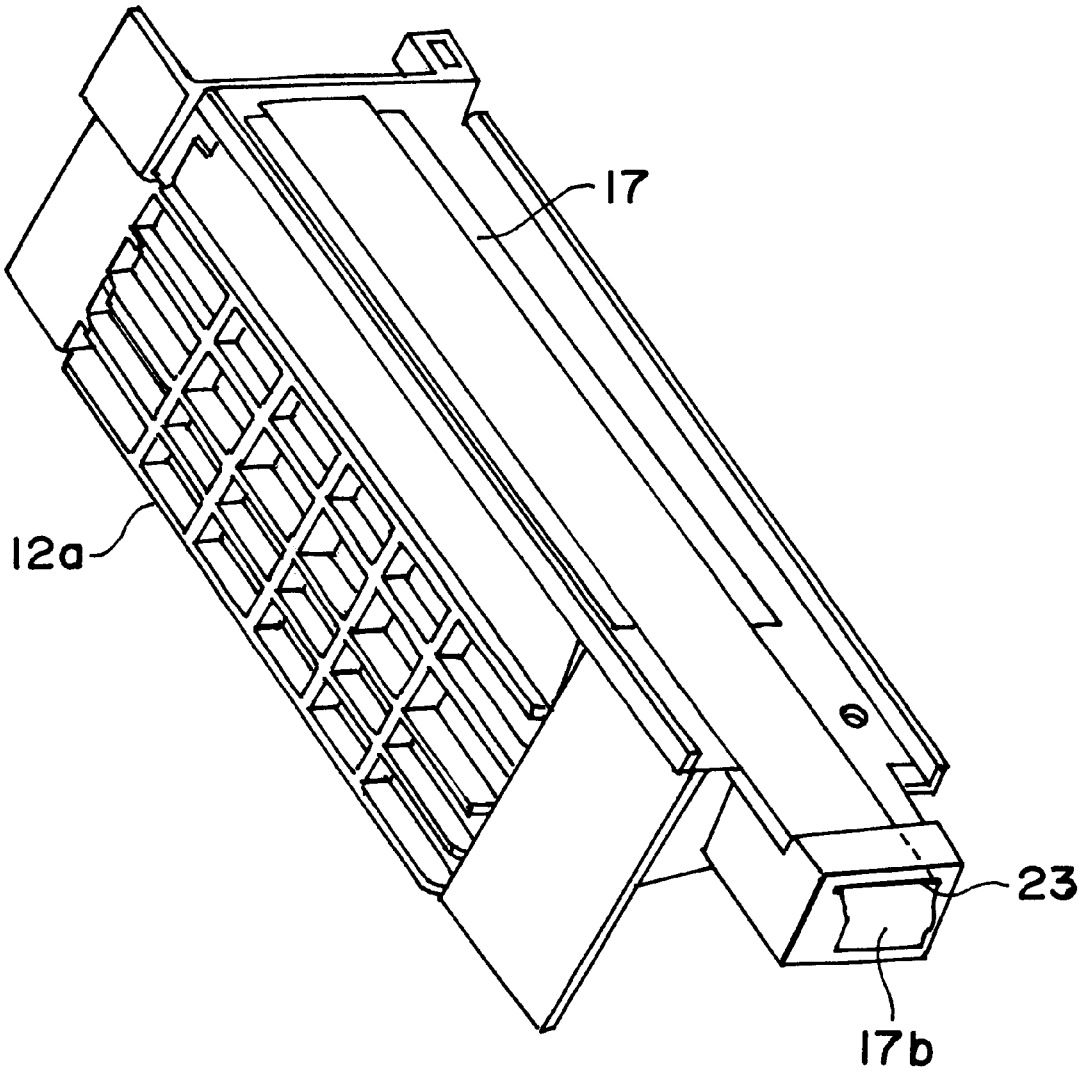
FIG. 15 is a perspective view of a toner container provided with a seal draw-out opening.

In this embodiment, the regulating member is not used, either, but a seal draw-out opening 23 capable of regulating the seal pulling direction is integrally provided in the toner accommodating container 12*a,* as if FIG. 15. The drawing portion 17*b* at the free end of the seal member 17 is inserted into the seal draw-out opening 23. In the other respects, this embodiment is the same as in the Embodiment 1.

The section of the seal draw-out opening 23 is such that the long side thereof is slightly larger than the width of the portion 17*c,* and the short side is slightly larger than the thickness of the seal member 17. It penetrates in the drawing direction of the seal member 17. The draw-out opening 23 is disposed downstream of the seal member 19 between the container, in the drawing direction of the seal member 17.

With the developing device 10 manufactured in the manner described in the foregoing, the smoothness of the seal pulling at the seal draw-out opening, the operativity, the tearing stability and the withstand pressure property have been checked, similarly to Embodiment 1.

As a result, the seal was smoothly pulled until the opening of the toner supply opening without clogging at the seal draw-out opening both when the seal was pulled straight or when it was pulled obliquely. As regards operativity, the peeling strength is approximately 3 kgf, which is good. As regards the tearing stability, the seal was torn along the tearable portions 17*c,* and stabilized widths of the opening were provided. No peeling was observed between layers.

The withstand pressure acceleration was as large as 150G, which is sufficient.

(Embodiment 5)

In this embodiment, the tearable seal member 17 is used for a developer supply container 50 for supplying the developer into the electrophotographic image forming apparatus. When the developer in the main assembly of the apparatus is consumed, the operator tears the seal member 17 to unseal the opening 50*a* by which the developer is supplied into a developer receiving portion(unshown) of the main assembly.

The operativity, the tearing stability and the withstand pressure property are checked. As a result, the opening 50*a* was smoothly opened. As regards the operativity, the peeling strength is approximately 3 kgf, which is good. As regards the tearing stability, the tape was torn along the portion 17*c,* and the provided opening width was stable. No peeling was observed between layers.

The sealing member of the embodiments are summarized as follows:

A sealing member (e.g. 17) for sealing a developer accommodating portion (e.g. 10*e*) for accommodating a developer, comprises:

(a) a sealing portion (e.g. 17*a*) for openably sealing an opening (e.g. 12*a*1) of the developer accommodating portion;

(b) an extended portion (e.g. 17*b*) extended from the sealing portion, the extended portion having a width, measured in a direction of extension, which is smaller than that of the sealing portion;

(c) a connecting edge (e.g. 17*e*) for connecting an edge (e.g. 17*a*1) of-said sealing portion adjacent said extended portion and a side edge (e.g. 17*b*1) of the extended portion extending in the direction of the extension and;

(d) a tearable portion (e.g. 17*c*) capable of being torn to open the opening sealed by the sealing portion, wherein an end of the tearable portion is provided in the sealing portion, and the other end thereof continues to the connecting edge, wherein the tearable portion extends between the one end and the other end substantially parallel with the extension direction.

the sealing member may be provided with a cavity (e.g. 31*c*1) in a direction of a thickness thereof, along the tearable portion.

the cavity may be provided by partly fusing a guide layer (e.g. said cavity) of the sealing member by a laser beam, wherein the sealing member has a surface layer (e.g. 31*a*), a laser beam blocking layer (e.g. 31*b*) for blocking the laser beam, the guide layer (e.g. 31*c*) fusible by the laser beam, and a sealant layer (e.g. 31*d*) for bonding the sealing member around the opening, in the order named in the direction of the thickness.

the cavity may be provided in a guide layer through a sealant layer by partly fusing the guide layer and the sealant layer of the sealing member by a laser beam, wherein the sealing member has a surface layer, a laser beam blocking layer for blocking the laser beam, the guide layer fusible by the laser beam, and the sealant layer for bonding the sealing member around the opening, in the order named in the direction of the thickness.

the connecting edge may be provided at each of lateral sides of the extended portion upstream side thereof in the extension direction, and the tearable portion is provided adjacent each of lateral sides of the sealing portion through the sealing portion and the extended portion.

The connecting edge may connect a downstream edge and a lateral edge of the extended portion, and is arcuately concave toward the inside.

said connecting edge may connect a downstream edge and a lateral edge of the extended portion, and is linearly inclined relative to the extension direction.

The developer accommodating portion may be provided in a developer supply container for supplying the developer into a main assembly of the electrophotographic image forming apparatus.

The developer accommodating portion may be provided in a process cartridge which is detachably mountable relative to a main assembly of an electrophotographic image forming apparatus, the process cartridge containing as a unit an electrophotographic photosensitive member, and process means actable on actable on the electrophotographic photosensitive member.

As described in the foregoing, according to the embodiments of the present invention, the sealing member can be assuredly removed.

Furthermore, the sealing member can be smoothly removed.

Moreover, the present invention provides a process cartridge and a developer supply container using such a sealing member.

While the invention has been described with reference to the structures disclosed herein, it is not confined to the details set forth and this application is intended to cover such modifications or changes as may come within the purposes of the improvements or the scope of the following claims.

What is claimed is:

1. A sealing member for sealing a developer accommodating portion for accommodating a developer, comprising:

(a) a sealing portion for openably sealing an opening of said developer accommodating portion;

(b) an extended portion extending from said sealing portion, said extended portion having a width, measured in a direction perpendicular to a direction of extension, which is smaller than that of said sealing portion;

(c) a connecting edge for connecting an edge of said sealing portion adjacent said extended portion and a side edge of said extended portion extending in the direction of the extension; and (d) a first and second easy-tear portions for opening said opening sealed by said sealing portion, wherein an end of each of said easy-tear portions is provided in said sealing portion, and the other end thereof continues to said connecting edge, wherein said easy-tear portions extend between said one end and said other end substantially parallel with the extension direction, and wherein a distance between said first and second easy-tear portions, measured in a direction perpendicular to the direction of the extension, is larger than a width of said extended portion.

2. A sealing member according to claim 1, wherein said sealing member is provided with cavities in a direction of a thickness thereof, along the easy-tear portions.

3. A sealing member according to claim 2, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided by partly fusing the fusible layer by the laser beam.

4. A sealing member according to claim 2, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided in the fusible layer through the sealant layer by partly fusing the fusible layer and the sealant layer by the laser beam.

5. A sealing member according to claim 1, wherein said connecting edge is provided at each of lateral sides of said extended portion at an upstream side thereof in the extension direction, and said tearable portion is provided adjacent each of lateral sides of said sealing portion through said sealing portion and said extended portion.

6. A sealing member according to claim 1, wherein said connecting edge connects a downstream edge and a lateral edge of said extended portion, and is arcuately concave toward the inside.

7. A sealing member according to claim 1, wherein said connecting edge connects a downstream edge and a lateral edge of said extended portion, and is linearly inclined relative to the extension direction.

8. A sealing member according to claim 1, wherein said developer accommodating portion is provided in a developer supply container for supplying the developer into a main assembly of an electrophotographic image forming apparatus.

9. A sealing member according to claim 1, wherein said developer accommodating portion is provided in a process cartridge which is detachably mountable relative to a main assembly of an electrophotographic image forming apparatus, the process cartridge containing as a unit an electrophotographic photosensitive member, and process means actable on said electrophotographic photosensitive member.

10. A sealing member for sealing a developer accommodating portion for accommodating a developer, comprising:

(a) a sealing portion for openably sealing an opening of said developer accommodating portion;

(b) an extended portion extending from said sealing portion, said extended portion having a width, measured in a direction perpendicular to a direction of extension, which is smaller than that of said sealing portion;

(c) a connecting edge for connecting an edge of said sealing portion adjacent said extended portion and a side edge of said extended portion extending in the direction of the extension, wherein said connecting edge is provided at each of lateral sides of said extended portion at an upstream side thereof in the extension direction;

(d) first and second easy-tear portions for opening said opening sealed by said sealing portion, wherein an end of each of said easy-tear portions is provided in said sealing portion, and the other end thereof continues to said connecting edge, wherein each of easy-tear portions extends between said one end and said other end substantially parallel with the extension direction, and said easy-tear portions are provided adjacent respective lateral sides of said sealing portion through said sealing portion and said extended portion, and wherein a distance between said first and second easy-tear portions, measured in a direction perpendicular to the direction of the extension, is larger than a width of said extended portion; and (e) cavities in a direction of a thickness of said sealing member, along the easy-tear portions.

11. A sealing member according to claim 10, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein the cavities are provided by partly fusing the fusible layer by the laser beam.

12. A sealing member according to claim 10, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided in the fusible layer through the sealant layer by partly fusing the fusible layer and the sealant layer by the laser beam.

13. A sealing member according to claim 10, wherein said connecting edge connects a downstream edge and a lateral edge of said extended portion, and is arcuately concave toward inside.

14. A sealing member according to claim 10, wherein said connecting edge connects a downstream edge and a lateral edge of said extended portion, and is linearly inclined relative to the extension direction.

15. A sealing member according to claim 10, wherein said developer accommodating portion is provided in a developer supply container for supplying the developer into a main assembly of an electrophotographic image forming apparatus.

16. A sealing member according to claim 10, wherein said developer accommodating portion is provided in a process cartridge which is detachably mountable relative to a main assembly of an electrophotographic image forming apparatus, the process cartridge containing as a unit an electrophotographic photosensitive member, and process means actable on said electrophotographic photosensitive member.

17. A sealing member for sealing a developer accommodating portion for accommodating a developer, comprising:

(a) a sealing portion for openably sealing an opening of said developer accommodating portion;

(b) an extended portion extending from said sealing portion, said extended portion having a width, measured in a direction perpendicular to a direction of extension, which is smaller than that of said sealing portion;

(c) a connecting edge for connecting an edge of said sealing portion adjacent said extended portion and a side edge of said extended portion extending in the direction of the extension, wherein said connecting edge is provided at each of lateral sides of said extended portion at an upstream side thereof in the extension direction;

(d) first and second easy-tear portions for opening said opening sealed by said sealing portion, wherein an end of each of said easy-tear portions is provided in said sealing portion, and the other end thereof continues to said connecting edge;

wherein each of said easy-tear portions extends between said one end and said other end substantially parallel with the extension direction, and said said easy-tear portions are provided adjacent each of lateral sides of said sealing portion through said sealing portion and said extended portion, and wherein a distance between said first and second easy-tear portions, measured in a direction perpendicular to the direction of the extension, is larger than a width of said extended portion; and (e) cavities extending in a direction of a thickness of said sealing member along the easy-tear portions, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided by partly fusing the fusible layer by the laser beam.

18. A sealing member according to claim 17, wherein said fusible layer is partly fused.

19. A sealing member according to claim 17, wherein said fusible layer and said sealant layer are partly fused continuously.

20. A sealing member according to claim 17, wherein said connecting edge connects a downstream edge and a lateral edge of said extended portion, and is arcuately concave toward the inside.

21. A sealing member according to claim 17, wherein said connecting edge connects a downstream edge and a lateral edge of said extended portion, and is linearly inclined relative to the extension direction.

22. A sealing member according to claim 17, wherein said developer accommodating portion is provided in a developer supply container for supplying the developer into a main assembly of an electrophotographic image forming apparatus.

23. A sealing member according to claim 17, wherein said developer accommodating portion is provided in a process cartridge which is detachably mountable relative to a main assembly of an electrophotographic image forming apparatus, the process cartridge containing as a unit an electrophotographic photosensitive member, and process means actable on said electrophotographic photosensitive member.

24. A process cartridge detachably mountable to a main assembly of an electrophotographic image forming apparatus, comprising:

(a) an electrophotographic photosensitive member:

(b) process means actable on said electrophotographic photosensitive member;

(c) a developer accommodating portion for accommodating a developer;

(d) a sealing member for sealing said developer accommodating portion, said sealing member including:

(1) a sealing portion for openably sealing an opening of said developer accommodating portion;

(2) an extended portion extending from said sealing portion, said extended portion having a width, measured in a direction perpendicular to a direction of extension, which is smaller than that of said sealing portion;

(3) a connecting edge for connecting an edge of said sealing portion adjacent said extended portion and a side edge of said extended portion extending in the direction of the extension; and (4) first and second easy-tear portions for opening said opening sealed by said sealing portion, wherein an end of each of said easy-tear portions is provided in said sealing portion, and the other end thereof continues to said connecting edge, wherein each of said easy-tear portions extends between said one end and said other end substantially parallel with the extension direction, and wherein a distance between said first and second easy-tear portions, measured in a direction perpendicular to the direction of the extension, is larger than a width of said extended portion.

25. A process cartridge according to claim 24, wherein said sealing member is provided with cavities extending in a direction of a thickness of said sealing member along the easy-tear portions portions.

26. A process cartridge according to claim 25, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided by partly fusing the fusible layer by a laser beam.

27. A process cartridge according to claim 25, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided in the fusible layer through the sealant layer by partly fusing the fusible layer and the sealant layer by a laser beam.

28. A process cartridge according to claim 24, wherein said connecting edge is provided at each of lateral sides of said extended portion upstream side thereof in the extension direction, and said tearable portion is provided adjacent each of lateral sides of said sealing portion through said sealing portion and said extended portion.

29. A process cartridge according to claim 24, wherein said connecting edge connects a downstream edge and a lateral edge of said extended portion, and is arcuately concave toward the inside.

30. A process cartridge according to claim 24, wherein said connecting edge connects a downstream edge and a lateral edge of said extended portion, and is linearly inclined relative to the extension direction.

31. A process cartridge according to claim 24, wherein said process means is one of charging means for charging said electrophotographic photosensitive member, developing means for developing a latent image formed on the electrophotographic photosensitive member, and cleaning means for removing the developer remaining on said electrophotographic photosensitive member.

32. A process cartridge according to claim 24, wherein said process cartridge contains the developer.

33. A process cartridge detachably mountable to a main assembly of an electrophotographic image forming apparatus, comprising:

(a) an electrophotographic photosensitive member;

(b) developing means for developing a latent image formed on the electrophotographic photosensitive member;

(c) a developer accommodating portion for accommodating a developer; and (d) a sealing member for sealing said developer accommodating portion, said sealing member including:

(1) a sealing portion for sealing an opening of said developer accommodating portion, said sealing portion being openable to permit the developer accommodated in said developer accommodating portion to be supplied out of said developer accommodating portion;

(2) an extended portion extending from said sealing portion, said extended portion having a width, measured in a direction perpendicular to a direction of extension, which is smaller than that of said sealing portion;

(3) a connecting edge for connecting an edge of said sealing portion adjacent said extended portion and a side edge of said extended portion extending in the direction of the extension, wherein said connecting edge is provided at each of lateral sides of said extended portion at an upstream side thereof in the extension direction; and (4) first and second easy-tear portions for opening said opening sealed by said sealing portion, wherein an end of each of said easy-tear portions is provided in said sealing portion, and the other end thereof continues to said connecting edge, wherein each of said easy-tear portions extends between said one end and said other end substantially parallel with the extension direction, and said said easy-tear portions are provided adjacent each of lateral sides of said sealing portion through said sealing portion and said extended portion; wherein a distance between said first and second easy-tear portions, measured in a direction perpendicular to the direction of the extension, is larger than a width of said extended portion; and (5) cavities extending in a direction of a thickness of said sealing member, along the easy-tear portions.

34. A process cartridge according to claim 33, wherein said sealing member has a multi-layer structure comprising a surface layer, a laser beam blocking layer for blocking a laser beam, a fusible layer fusible by the laser beam, and a sealant layer for bonding said sealing member around said opening in the order named in the direction of the thickness, wherein said cavities are provided by partly fusing the fusible layer by the laser beam.

35. A process cartridge according to claim 32, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided in the fusible layer through the sealant layer by partly fusing the fusible layer and the sealant layer by the laser beam.

36. A process cartridge according to claim 33, wherein said connecting edge connects a downstream edge and a lateral edge of said extended portion, and is arcuately concave toward the inside.

37. A process cartridge according to claim 33, wherein said connecting edge connects a downstream edge and a lateral edge of said extended portion, and is linearly inclined relative to the extension direction.

38. A process cartridge according to claim 33, further comprising a process means actable on said electrophotographic photosensitive member, wherein said process means is one of charging means for charging said electrophotographic photosensitive member, and cleaning means for removing the developer remaining on said electrophotographic photosensitive member.

39. A process cartridge detachably mountable to a main assembly of an electrophotographic image forming apparatus, comprising:

(a) an electrophotographic photosensitive member;

(b) developing means for developing a latent image formed on the electrophotographic photosensitive member;

(c) a developer accommodating portion for accommodating a developer; and (d) a sealing member for sealing said developer accommodating portion, said sealing member including:

(1) a sealing portion for sealing an opening of said developer accommodating portion, said sealing portion being openable to permit the developer accommodated in said developer accommodating portion to be supplied out of said developer accommodating portion;

(2) an extended portion extending from said sealing portion, said extended portion having a width, measured in a direction perpendicular to a direction of extension, which is smaller than that of said sealing portion;

(3) a connecting edge for connecting an edge of said sealing portion adjacent said extended portion and a side edge of said extended portion extending in the direction of the extension, wherein said connecting edge is provided at each of lateral sides of said extended portion at an upstream side thereof in the extension direction;

(4) first and second easy-tear portions for opening said opening sealed by said sealing portion, wherein an end of each of said easy-tear portions is provided in said sealing portion, and the other end thereof continues to connecting edge;

wherein each of said easy-tear portions extend between said one end and said other end substantially parallel with the extension direction, and said easy-tear portions are provided adjacent each of lateral sides of said sealing portion through said sealing portion and said extended portion, and wherein a distance between said first and second easy-tear portions, measured in a direction perpendicular to the direction of extension, is larger than a width of said extended portion; and (5) cavities extending in a direction of a thickness of said sealing member, along the easy-tear portions, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided by partly fusing the fusible layer by the laser beam.

40. A process cartridge according to claim 39, wherein said fusible layer is partly fused.

41. A process cartridge according to claim 39, wherein said fusible layer and said sealant layer are partly fused continuously.

42. A process cartridge according to claim 39, wherein said connecting edge connects a downstream edge and a lateral edge of said extended portion, and is arcuately concave toward the inside.

43. A process cartridge according to claim 39, wherein said connecting edge connects a downstream edge and a lateral edge of said extended portion, and is linearly inclined relative to the extension direction.

44. A process cartridge according to claim 38, further comprising a process means actable on said electrophotographic photosensitive member, wherein said process means is one of charging means for charging said electrophotographic photosensitive member, and cleaning means for removing the developer remaining on said electrophotographic photosensitive member.

45. A developer supply container for supplying a developer to a main assembly of an electrophotographic image forming apparatus, comprising:

(a) a developer accommodating portion for accommodating a developer; and (b) a sealing member for sealing said developer accommodating portion, said sealing member including:

(1) a sealing portion for openably sealing an opening of said developer accommodating portion;

(2) an extended portion extending from said sealing portion, said extended portion having a width, measured in a direction perpendicular to a direction of extension, which is smaller than that of said sealing portion;

(3) a connecting edge for connecting an edge of said sealing portion adjacent said extended portion and a side edge of said extended portion extending in the direction of the extension; and (4) first and second easy-tear portions for opening said opening sealed by said sealing portion, wherein an end of each of said easy-tear portions easy-tear portions extends between said one end and said other end substantially parallel with the extension direction, and wherein a distance between said first and second easy-tear portions, measured in a direction perpendicular to the direction of the extension, is larger than a width of said extended portion.

46. A developer supply container according to claim 45, wherein said sealing member is provided with a cavities extending in a direction of a thickness of said sealing member along the easy-tear portions.

47. A developer supply container according to claim 46, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided by partly fusing the fusible layer by the laser beam.

48. A developer supply container according to claim 46, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided in the fusible layer through the sealant layer by partly fusing the fusible layer and the sealant layer by the laser beam.

49. A developer supply container according to claim 45, wherein said connecting edge is provided at each of lateral sides of said extended portion at an upstream side thereof in the extension direction, and said easy-tear portions are provided adjacent respective lateral sides of said sealing portion through said sealing portion and said extended portion.

50. A developer supply container according to claim 45, wherein said connecting edge connects a downstream edge and a lateral edge of said extended portion, and is arcuately concave toward inside.

51. A developer supply container according to claim 45, wherein said connecting edge connects a downstream edge and a lateral edge of said extended portion, and is linearly inclined relative to the extension direction. A developer supply container for supplying a developer to a main assembly of an electrophotographic image forming apparatus, comprising:

(a) a developer accommodating portion for accommodating a developer; and (b) a sealing member for sealing said developer accommodating portion, said sealing member including:

(1) a sealing portion for sealing an opening of said developer accommodating portion, said sealing portion being openable to permit the developer accommodated in said developer accommodating portion to be supplied out of said developer accommodating portion;

(2) an extended portion extending from said sealing portion, said extended portion having a width, measured in a direction perpendicular to a direction of extension, which is smaller than that of said sealing portion;

(3) a connecting edge for connecting an edge of said sealing portion adjacent said extended portion and a side edge of said extended portion extending in the direction of the extension, wherein said connecting edge is provided at each of lateral sides of said extended portion at an upstream side thereof in the extension direction;

(4) first and second easy-tear portions for opening said opening sealed by said sealing portion, wherein an end of each of said easy-tear portions is provided in said sealing portion, and the other end thereof continues to said connecting edge;

wherein each of said easy-tear portions extends between said one end and said other end substantially parallel with the extension direction, and said easy-tear portions are provided adjacent each of lateral sides of said sealing portion through said sealing portion and said extended portion, and wherein a distance between said first and second easy-tear portions, measured in a direction perpendicular to the direction of the extension, is larger than a width of said extended portion; and (5) cavities extending in a direction of a thickness of said sealing member, along the easy-tear portions.

52. A developer supply container according to claim 45, wherein said developer supply container contains the developer. A developer supply container according to claim 51, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of thickness, wherein said cavities are provided by partly fusing the fusible layer by the laser beam.

53. A developer supply container for supplying a developer to a main assembly of an electrophotographic image forming apparatus, comprising:

(a) a developer accommodating portion for accommodating a developer; and (b) a sealing member for sealing said developer accommodating portion, said sealing member including:

(1) a sealing portion for sealing an opening of said developer accommodating portion, said sealing portion being openable to permit the developer accommodated in said developer accommodating portion to be supplied out of said developer accommodating portion;

(2) an extended portion extending from said sealing portion, said extended portion having a width measured in a direction perpendicular to a direction of extension, which is smaller than that of said sealing portion;

(3) a connecting edge for connecting an edge of said sealing portion adjacent said extended portion and a side edge of said extended portion extending in the direction of the extension, wherein said connecting edge is provided at each of lateral sides of said extended portion at an upstream side thereof in the extension direction;

(4) first and second easy-tear portions for opening said opening sealed by said sealing portion, wherein an end of each of said easy-tear portions is provided in said sealing portion, and the other end thereof continues to said connecting edge, wherein each of said easy-tear portions extends between said one end and said other end substantially parallel with the extension direction, and said easy-tear portions are provided adjacent each of lateral sides of said sealing portion through said sealing portion and said extended portion, and wherein a distance between said first and second easy-tear portions, measured in a direction perpendicular to the direction of the extension, is larger than a width of said extension; and (5) cavities extending in a direction of a thickness of said sealing member along the easy-tear portions.

54. A developer supply container according to claim 53, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness wherein said cavities are provided in the fusible layer through said sealant layer by partly fusing the fusible layer and the sealant layer by the laser beam.

55. A developer supply container according to claim 53, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided in the fusible layer through said sealant layer by partly fusing the fusible layer and the sealant layer by the laser beam.

56. A developer supply container according to claim 53, wherein said connecting edge connects a downstream edge and a lateral edge of said extended portion, and is arcuately concave toward the inside.

57. A developer supply container according to claim 53, wherein said connecting edge connects a downstream edge and a lateral edge of said extended portion, and is linearly inclined relative to the extension direction.

58. A developer supply container for supplying a developer to a main assembly of an electrophotographic image forming apparatus, comprising:

(a) a developer accommodating portion for accommodating a developer; and (b) a sealing member for sealing said developer accommodating portion, said sealing member including:

(1) a sealing portion for sealing an opening of said developer accommodating portion, said sealing portion being openable to permit the developer accommodated in said developer accommodating portion to be supplied out of said developer accommodating portion;

(2) an extended portion extending from said sealing portion, said extended portion having a width measured in a direction perpendicular to a direction of extension, which is smaller than that of said sealing portion;

(3) a connnecting edge for connecting an edge of said sealing portion adjacent said extended portion and a side edge of said extended portion extending in the direction of the extension, wherein said connecting edge is provided at each of lateral sides of said extended portion at an upstream side thereof in the extension direction;

(4) first and second easy-tear portions for opening said opening sealed by said sealing portion, wherein an end of each of said easy-tear portions is provided in said sealing portion, and the other end thereof continues to said connecting edge, wherein each of said easy-tear portions extends between said one end and said other end substantially parallel with the extension direction, and said easy-tear portions are provided adjacent each of lateral sides of said sealing portion through said sealing portion and said extended portion, and wherein a distance between said first and second easy-tear portions, measured in a direction perpendicular to the direction of extension, is larger than a width of said extension; and (5) cavities extending in a direction of a thickness of said sealing member along the easy-tear portions, wherein said sealing member has a multi-layer structure comprising a surface layer, a laser beam blocking layer for blocking a laser beam, a fusible layer fusible by the laser beam, and a sealant layer for bonding said sealing member around said opening, in the order named in the direction of the thickness, wherein said cavities are provided by partly fusing the fusible layer by the laser beam.

59. A developer supply container according to claim 58, wherein said fusible layer is partly fused.

60. A developer supply container according to claim 58, wherein said fusible layer and said sealant layer are partly fused continuously.

61. A developer supply container according to claim 58, wherein said connecting edge connects a downstream edge and a lateral ede of said extended portion, and is arcuately concave toward the inside.

62. A developer supply container according to claim 58, wherein said connecting edge connects a downstream edge and a lateral ede of said extended portion, and is linearly inclined relative to the extension direction.

63. A sealing member for sealing a developer accommodating portion for accommodating a developer, comprising:

a sealing portion for openably sealing an opening of said developer accommodating portion;

an extended portion extending from said sealing portion, said extended portion having a first portion, having a width, measured in a direction perpendicular to a direction of extension of said extended portion, smaller than that of said sealing portion, and a second portion provided adjacent to said sealing portion and having a width, measured in the perpendicular direction, which increases toward said sealing portion; and first and second easy-tear portions for opening said opening sealed by said sealing portion, wherein an end of each of said easy-tear portions is provided at an edge of said second portion, and wherein a distance between said first and second easy-tear portions, measured in a direction perpendicular to the direction of the extension, is larger than a width of said first portion.

64. A sealing member according to claim 63, wherein said sealing member is provided with cavities in a direction of a thickness thereof, along the easy-tear portions.

65. A sealing member according to claim 64, wherein said sealing member has a multi-layer structure comprising a surface layer, a laser beam blocking layer for blocking a laser beam, a fusible layer fusible by the laser beam, and a sealant layer for bonding said sealing member to said developer accommodating portion, in the order named in the direction of the thickness, wherein said cavities are provided by partly fusing the fusible layer by the laser beam.

66. A sealing member according to claim 63, wherein an end of each of said first and second easy-tear portions crosses a concave arcuate portion of said second portion.

67. A sealing member according to claim 63, wherein an end of each of said first and second easy-tear portions crosses with a linear portion, inclined relative to the direction of the extension, of said second portion.

68. A sealing member according to claim 63, wherein each of said first and second easy-tear portions is extended linearly from said second portion over said sealing portion along and in parallel with said opening.

69. A sealing member according to claim 63, wherein parts of said sealing portion which are welded to said developer accommodating portion are extended in the direction of extension laterally outside said first and second easy-tear portions.

70. A sealing member according to claim 63, wherein parts of said sealing portion which are welded to said developer accommodating portion are provided at an end of said sealing portion laterally outside said first and second easy-tear portions adjacent ends of said first and second easy-tear portions.

71. A developer supply container for supplying a developer to a main assembly of an electrophotographic image forming apparatus, comprising:

(a) a developer accommodating portion for accommodating a developer;

(b) a sealing member for sealing said developer accommodating portion, said sealing member including:

a sealing portion for openably sealing an opening of said developer accommodating portion;

an extended portion extending from said sealing portion, said extended portion having a first portion, having a width, measured in a direction perpendicular to a direction of extension of said extended portion, smaller than that of said sealing portion, and a second portion provided adjacent to said sealing portion and having a width, measured in the perpendicular direction, which increases toward said sealing portion; and first and second easy-tear portions for opening said opening sealed by said sealing portion, wherein an end of each of said easy-tear portions is provided at an edge of said second portion, and wherein a distance between said first and second easy-tear portions, measured in a direction perpendicular to the direction of the extension, is larger than a width of said first portion.

72. A developer supply container according to claim 71, wherein said sealing member is provided with cavities in a direction of a thickness thereof, along the easy-tear portions.

73. A developer supply container according to claim 72, wherein said sealing member has a multi-layer structure comprising a surface layer, a laser beam blocking layer for blocking a laser beam, a fusible layer fusible by the laser beam, and a sealant layer for bonding said sealing member to said developer accommodating portion, in the order named in the direction of the thickness, wherein said cavities are provided by partly fusing the fusible layer by the laser beam.

74. A developer supply container according to claim 71, wherein an end of each of said first and second easy-tear portions crosses a concave arcuate portion of said second portion.

75. A developer supply container according to claim 71, wherein an end of each of said first and second easy-tear portions crosses with a linear portion, inclined relative to the direction of the extension, of said second portion.

76. A developer supply container according to claim 71, wherein each of said first and second easy-tear portions is extended linearly from said second portion over said sealing portion along and parallel with said opening.

77. A developer supply container according to claim 71, wherein parts of said sealing portion which are welded to said developer accommodating potion are extended in the direction of extension laterally outside said first and second easy-tear portions.

78. A developer supply container according to claim 71, wherein parts of said sealing portion which are welded to said developer accommodating portion are provided at an end of said sealing portion laterally outside said first and second easy-tear portions adjacent ends of said first and second easy-tear portions.

79. A developer supply container according to claim 71, wherein said developer supply container contains the developer.

80. A process cartridge detachably mountable to a main assembly of an electrophotographic image forming apparatus, comprising:

(a) an image bearing member;

(b) a process means actable on said image bearing member;

(c) a developer accommodating portion for accommodating a developer;

(d) a sealing member for sealing said developer accommodating portion, said sealing member including:

a sealing portion for openably sealing an opening of said developer accommodating portion;

an extended portion extending from said sealing portion, said extended portion having a first portion, having a width, measured in a direction perpendicular to a direction of extension of said extended portion, smaller than that of said sealing portion, and a second portion provided adjacent to said sealing portion and having a width, measured in the perpendicular direction, which increases toward said sealing portion; and first and second easy-tear portions for opening said opening sealed by said sealing portion, wherein an end of each of said easy-tear portions is provided at an edge of said second portion, and wherein a distance between said first and second easy-tear portions, measured in a direction perpendicular to the direction of the extension, is larger than a width of said first portion.

81. A process cartridge according to claim 80, wherein said sealing member is provided with cavities in a direction of a thickness thereof, along the easy-tear portions.

82. A process cartridge according to claim 81, wherein said sealing member has multi-layer structure comprising a surface layer, a laser beam blocking layer for blocking a laser beam, a fusible layer fusible by the laser beam, and a sealant layer for bonding said sealing member to said developer accommodating portion, in the order named in the direction of the thickness, wherein said cavities are provided by partly fusing the fusible layer by the laser beam.

83. A process cartridge according to claim 80, wherein an end of each of said first and second easy-tear portions crosses a concave arcuate portion of said second portion.

84. A process cartridge according to claim 80, wherein an end of each of said first and second easy-tear portions crosses with a linear portion, inclined relative to the direction of the extension, of said second portion.

85. A process cartridge according to claim 80, wherein of each of said first and second easy-tear portions is extended linearly from said second portion over said sealing portion along and parallel with said opening.

86. A process cartridge according to claim 80, wherein parts of said sealing portion which are welded to said developer accommodating portion are extended in the direction of extension laterally outside said first and second easy-tear portions.

87. A process cartridge according to claim 80, wherein parts of said sealing portion which are welded to said developer accommodating portion are provided at an end of said sealing portion laterally outside said first and second easy-tear portions adjacent ends of said first and second easy-tear portions.

88. A process cartridge according to claim 80, wherein said image bearing member is an electrophotographic photosensitive member.

89. A process cartridge according to claim 80, wherein said process cartridge contains the developer.

* * * * *

UNITED STATES PATENT AND TRADEMARK OFFICE

CERTIFICATE OF CORRECTION

PATENT NO. : 6,118,957

DATED : September 12, 2000

INVENTOR(S): YASUO FUJIWARA, ET AL.

It is certified that error appears in the above-identified patent and that said Letters Patent is hereby corrected as shown below:

COLUMN 2:
Line 8, "teared." should read –torn--.

COLUMN 3:
Line 53, "the in" should read –in the--.

COLUMN 5:
Line 56, "present" should read –prevent--.

COLUMN 7:
Line 49, "it is" should read –they are--.
Line 64, "is" should read –are--.

COLUMN 9:
Line 3, "and" should be deleted.
Line 6, "strength," should read –strength and--.

UNITED STATES PATENT AND TRADEMARK OFFICE

CERTIFICATE OF CORRECTION

PATENT NO. : 6,118,957

DATED : September 12, 2000

INVENTOR(S): YASUO FUJIWARA, ET AL.

It is certified that error appears in the above-identified patent and that said Letters Patent is hereby corrected as shown below:

COLUMN 12:
Line 31, "said" should read –The--.

COLUMN 15:
Line 67, "member:" should read –member;--.

COLUMN 16:
Line 33, "portions" (1st occurrence) should be deleted.

COLUMN 17:
Line 43, "said" should be deleted.
Line 61, "claim 32," should read –claim 33,--.

COLUMN 19:
Line 18, "claim 38," should read –claim 39,--.
Line 45, "easy-tear portions" should be deleted.
Line 53, "a" should be deleted.

UNITED STATES PATENT AND TRADEMARK OFFICE

CERTIFICATE OF CORRECTION

PATENT NO. : 6,118,957

DATED : September 12, 2000

INVENTOR(S): YASUO FUJIWARA, ET AL.

It is certified that error appears in the above-identified patent and that said Letters Patent is hereby corrected as shown below:

COLUMN 20:

Line 16, "inside." should read –the inside.--.

Line 20 "A developer" should be deleted.

Lines 21-62 should be deleted.

Lines 63-65, "A developer supply container according to claim 45, wherein said developer supply container contains the developer." should be deleted.

Line 66, "claim 51" should read --claim 53--.

COLUMN 21:

Line 56, "claim 53" should read --claim 45, wherein said developer supply container contains the developer."--.

Lines 57-64 should be deleted.

COLUMN 22:

Line 60, "ede" should read –edge--.

Line 64, "ede" should read –edge--.

UNITED STATES PATENT AND TRADEMARK OFFICE

CERTIFICATE OF CORRECTION

PATENT NO. : 6,118,957

DATED : September 12, 2000

INVENTOR(S): YASUO FUJIWARA, ET AL.

It is certified that error appears in the above-identified patent and that said Letters Patent is hereby corrected as shown below:

COLUMN 24:
Line 34, "potion" should read –portion--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*